US009185490B2

(12) United States Patent
Starobin

(10) Patent No.: US 9,185,490 B2
(45) Date of Patent: Nov. 10, 2015

(54) SINGLE ENCLOSURE SURROUND SOUND LOUDSPEAKER SYSTEM AND METHOD

(76) Inventor: Bradley M. Starobin, Baltimore, MD (US)

( * ) Notice: Subject to any disclaimer, the term of this patent is extended or adjusted under 35 U.S.C. 154(b) by 1020 days.

(21) Appl. No.: 13/295,972

(22) Filed: Nov. 14, 2011

(65) Prior Publication Data

US 2012/0121092 A1 May 17, 2012

Related U.S. Application Data

(60) Provisional application No. 61/413,206, filed on Nov. 12, 2010.

(51) Int. Cl.

| | |
|---|---|
| ***H04R 5/02*** | (2006.01) |
| ***H04R 5/04*** | (2006.01) |
| *H04R 29/00* | (2006.01) |
| *H04S 3/00* | (2006.01) |

(52) U.S. Cl.

CPC .. *H04R 5/04* (2013.01); *H04R 5/02* (2013.01); *H04R 29/008* (2013.01); *H04R 2201/028* (2013.01); *H04R 2205/022* (2013.01); *H04R 2420/07* (2013.01); *H04S 3/008* (2013.01); *H04S 2420/01* (2013.01)

(58) Field of Classification Search

CPC ..... H04R 5/02; H04R 5/04; H04R 2201/028; H04R 2205/022; H04R 2420/07; H04R 29/008; H04S 2420/01; H04S 3/008

USPC ..... 381/18, 335, 61

See application file for complete search history.

(56) References Cited

U.S. PATENT DOCUMENTS

| | | | | |
|---|---|---|---|---|
| 5,109,416 | A * | 4/1992 | Croft | 381/304 |
| 5,487,113 | A * | 1/1996 | Mark et al. | 381/17 |
| 5,870,484 | A | 2/1999 | Greenberger | |
| 6,937,737 | B2 | 8/2005 | Polk, Jr. | |
| 7,231,053 | B2 | 6/2007 | Polk, Jr. | |
| 7,593,533 | B2 | 9/2009 | Fincham | |
| 2009/0161880 | A1 * | 6/2009 | Hooley et al. | 381/17 |
| 2010/0042925 | A1 * | 2/2010 | DeMartin et al. | 715/716 |
| 2011/0261981 | A1 * | 10/2011 | Fincham | 381/302 |
| 2013/0156202 | A1 * | 6/2013 | Hamacher | 381/23.1 |

* cited by examiner

*Primary Examiner* — Fan Tsang
*Assistant Examiner* — Eugene Zhao
(74) *Attorney, Agent, or Firm* — J. Andrew McKinney, Jr.; McKinney & Associates, LLC

(57) ABSTRACT

A single enclosure loudspeaker system projects multi-channel surround sound into a listener's room, and so replaces multiple conventional surround channel loudspeakers. The loudspeaker system includes a pair of opposing multi transducer arrays oriented laterally toward walls or reflecting surfaces (relative to the viewing axis) within the media space. The multi-element arrays are housed in a single self-powered loudspeaker enclosure along with a single (or multiple) low-frequency electro-acoustical drive element(s). In one embodiment of the invention, surround channel program material is pre-processed by an integrated wireless transmission device that performs certain digital signal processing and channel mixing steps in advance of wireless surround signal broadcast to a receiver.

20 Claims, 16 Drawing Sheets

SINGLE ENCLOSURE SURROUND SOUND LOUDSPEAKER SYSTEM AND METHOD

This application claims priority benefit of U.S. Provisional Application No. 61/413,206, filed Nov. 12, 2010, and entitled, "Single Enclosure Surround Sound Loudspeaker System and Method", the disclosure of which is hereby incorporated herein in its entirety.

BACKGROUND OF THE INVENTION

1. Field of the Invention

The present invention relates in general to the reproduction of sound and more specifically to the application of acoustic and psycho-acoustic principles in the design of a loudspeaker system for use in multi-channel systems generically known as "surround-sound" systems which typically include a plurality of loudspeakers arrayed beside and behind the listeners.

2. Discussion of the Prior Art

Traditional home-theater installations configured to provide "surround sound" require the use or installation of multiple loudspeakers, typically incorporating at least two surround channel loudspeakers placed laterally and behind the home-theater seating area in accordance with industry standards such as Dolby Digital™ and compatible formats. Installing and wiring conventional multiple-speaker surround channel systems, which are typically far removed from the associated multichannel audio processor and power amplifier often integrated into a home theater receiver, involves significant effort on the part of the consumer and may severely compromise home décor.

Some prior art loudspeakers that have been adapted for use as surround systems have utilized wireless links in order to simplify installation and to omit speaker cables, and have even been configured to resemble lamp fixtures, as a concession to home décor. Such adaptive systems represent an awkward compromise, however, because the optimum location for a lamp fixture to enable it to provide good lighting effects very likely will not match the optimum location for a surround system speaker, which must be configured for effective presentation of the surround sound. The end result of such attempts have been expensive lamps which sound bad.

Generally speaking, home theater sound systems are difficult and expensive to install, partly because placement of the surround loudspeakers is awkward and the wiring needed to connect the speakers to the sound source often requires either unsightly bundles of cables or requires complicated in-wall installation. These difficulties often lead to compromises wherein sonic performance is diminished by poor surround speaker placement choices that are dictated by installation requirements.

There is a need, therefore, for a convenient, flexible, inexpensive and unobtrusive system and method for providing satisfying playback of surround sound in a home theater user's listening space.

OBJECTS AND SUMMARY OF THE INVENTION

It is, therefore, an object of the present invention to provide a convenient, easy-to-install, and unobtrusive surround sound system for audio installations. More particularly, it is an object of the invention to provide such a system which is wireless, and which is contained in a single enclosure for easy installation while providing a realistic, credible surround audio experience for a listener.

Briefly, in accordance with a first aspect of the present invention, a single-enclosure loudspeaker system is provided which incorporates multiple loudspeakers, or transducers, which are driven by a suitable audio source through filter circuitry which relies on psycho-acoustic principles and analyses of cranial anatomy of listeners to provide left and right surround audio signals. These filtered signals drive the transducers in the single enclosure to project multi-channel surround sound into a listener's room to produce phantom surround sound speaker positions, so that the single enclosure replaces multiple conventional surround channel loudspeakers.

In accordance with another aspect, the invention relates to a method for driving a single-enclosure surround sound loudspeaker system which incorporates multiple loudspeakers to produce multiple apparent, or phantom, loudspeaker positions to the rear of a listening position in a room. The method includes the steps of supplying left and right surround audio signals from an audio source to signal processing circuitry for manipulating variables in frequency responses and time delays in the audio signals. Digital processing software which relies on psycho-acoustic principles and analyses of cranial anatomy of listeners to determine how a listener perceives direction and distance based on sound information such as the frequencies and phase relationships of the sound waves reaching the listener's ears. This analysis is incorporated in the processing circuitry software for "characterizing" the source audio signals so that when they are projected against a reflective surface they will replicate in the reflected sound waves a desired pattern that will give the illusion of one or more directional sources. This circuitry and software, which hereafter will be referred to as "filter" circuitry, thus provides audio surround signals to drive corresponding left and right loudspeaker transducers, which form a controlled dispersion array in the single enclosure to project multi-channel surround sound into a listener's room, thereby producing surround audio at phantom surround sound speaker positions and creating the illusion of directional sound effects.

The method further includes enhancing the directional effects of the manipulated, or filtered, sounds by orienting laterally opposed loudspeaker arrays in the single enclosure toward reflective surfaces in the room, and supplying left and right audio signals to respective arrays to project surround sound from the transducer arrays toward respective reflecting surfaces in the room. By causing the transducer arrays to operate out of phase to create null zones, realistic rear surround sounds are produced from a single compact speaker enclosure, and by wirelessly transmitting the received audio signals from the source to the speaker enclosure, the need for interconnecting cables and wires is eliminated.

The single-enclosure, multi-surround-channel loudspeaker system of the invention preferably includes a pair of opposing multi-transducer arrays located on opposite sides of the enclosure and oriented to face laterally toward walls or other reflective surfaces of the room or other media space in which the listener and the system are located. The pair of multi-transducer arrays is housed in a single, preferably self-powered, compact loudspeaker enclosure, which preferably also incorporates a single, downwardly-facing, low-frequency electro-acoustical drive element, or multiple such low-frequency elements if desired.

In one embodiment of the invention, audio signals from a source of surround channel audio program material, such as a conventional Audio/Video unit, are pre-processed by a separate wireless transmission (TX) interface that has discrete inputs for each of the four surround channels associated with systems such as Dolby Digital 7.1 and similar processing schemes (e.g., Dolby TrueHD, Dolby Digital EX and others) having SL, SR, SBL and SBR channels, with its two "surround back" SBL and SBR channels being attenuated and delayed relative to its lateral surround channels SL and SR as a means of ensuring laterally dominant ambient surround effects. The digital signal processing and channel mixing process steps on these signals are carried out in audio processor circuitry before transmitting them via wireless transmission or broadcast to a matched, integral receiver (RX) module which is incorporated into the loudspeaker system's enclosure. The receiver preferably is an integrated solid state module located in the remote single loudspeaker enclosure to receive the wirelessly transmitted surround audio signals and feeds the received signals through an additional DSP processor to on-board power amplifiers within the host loudspeaker enclosure. The DSP performs magnitude response shaping to provide acoustic cues in radiated sound from the loudspeakers (or transducers) that are appropriate for both de-localization of the actual source position and for localization of the sound produced by the transducers. Preferably, three sets of shaped responses are provided that are selectable to create the illusion of three different phantom audio sound source positions at the nearby walls or other reflective surfaces to accommodate three different locations of the speaker enclosure with respect to a listening position. This magnitude response shaping, along with other audio processing, occurs in advance of on-board power amplifiers within the loudspeaker system enclosure.

The single enclosure multi-surround channel loudspeaker system of the present invention generates audio outputs which, when reflected from room walls or surfaces and perceived by a listener, creates a sonic illusion of phantom sound sources, simulating the sound that would be heard from conventional separate, elevated surround loudspeakers, each reproducing a unique surround channel's program material. The enclosure of the invention may be placed at various locations in the room behind the listener; for example, on the listening room's floor, on a table or on a high shelf, and the switchable sound magnitude shaping produces corresponding elevated phantom sound sources that generate a surround sound effect that is perceived by a listener at the listening position in the room. The single enclosure multi-surround channel loudspeaker system of the present invention is easy to install, since it is wireless and its output can be easily switched to match its location, thereby reducing the chances of producing unsatisfactory surround sound effects due to poor speaker enclosure placement decisions based on wiring and other installation considerations.

There are known psycho-acoustic principals including the Haas (precedence) effect which have been advantageously applied in the present invention. The Haas precedence effect is a psycho-acoustic phenomenon that governs the listener's perceived or apparent location of acoustic sources in a manner which varies as a function of the direction from which first arrival (incident) sound waves originate. In the method of the present invention, delaying surround back program materials on SBL and SBR channels ensures that first arriving sound waves at the listener's position are reflections from side walls as opposed to direct energy from the loudspeaker enclosure. An all-pass filter is provided in the signal path of one of the two SB channels to invert the phase of the signal in one path, in advance of wireless broadcast to the receiving module, to ensure proper in-phase operation of the dual loudspeaker arrays when reproducing SB effects.

BRIEF DESCRIPTION OF THE DRAWINGS

The above and still further features and advantages of the present invention will become apparent upon consideration of the following detailed description of a specific embodiment thereof, particularly when taken in conjunction with the accompanying drawings, wherein like reference numerals in the various figures are utilized to designate like components, in which.

DESCRIPTION OF THE PREFERRED EMBODIMENT

Figure 1:
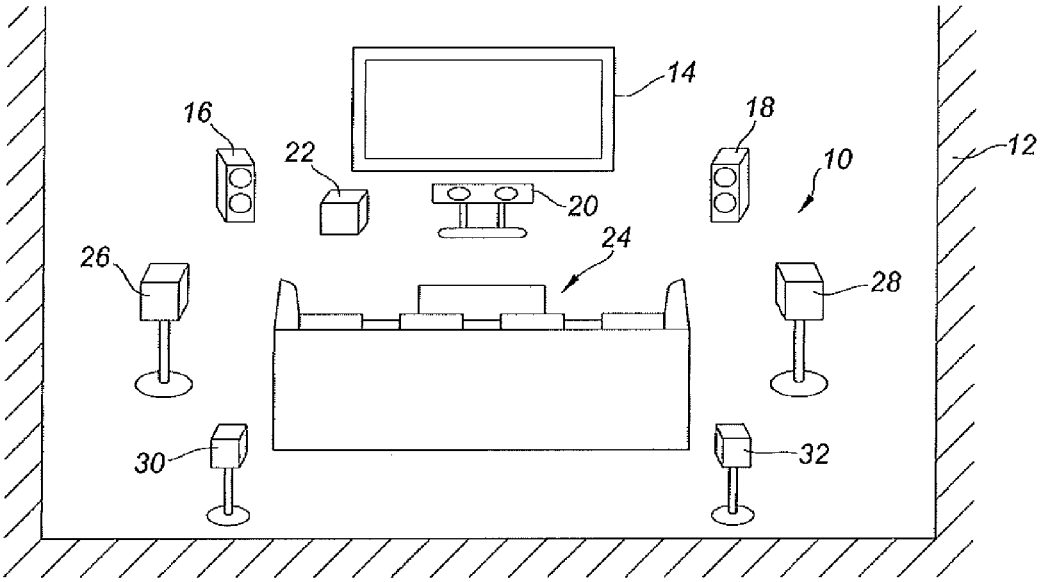
FIG. 1 (PRIOR ART)
FIG. 1 is a diagrammatic perspective view of a prior art Dolby Digital™ audio surround sound system incorporating loudspeakers in the front, side and rear of a listener position in a media room.
Figure 2:
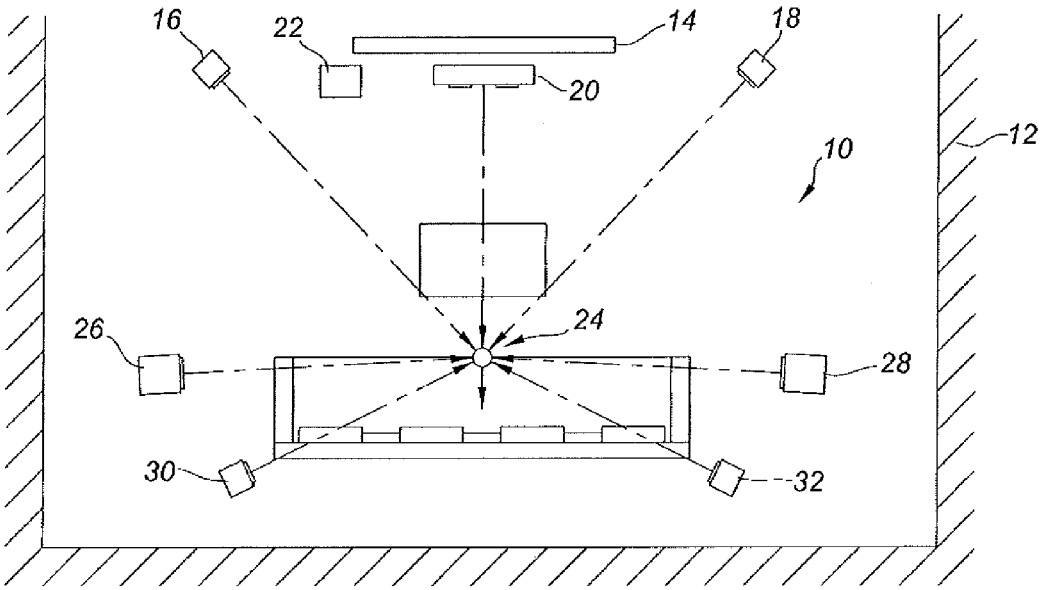
FIG. 2 (PRIOR ART)
FIG. 2 is a top view of the prior art system of FIG. 1.

Turning now to a more detailed consideration of the present invention, FIGS. 1 and 2 are perspective and top plan views of a typical prior art surround sound system, as generally indicated at 10, located in a media space, or room 12. The illustrated system is a conventional Dolby® digital set-up having a home theater or other audio/video (AV) source 14, left channel speakers 16, right channel speakers 18, and center channel speakers 20, and a subwoofer 22, located in front of a primary seating area for listeners at a listening station 24 such as a sofa or chairs or the like. The system includes a pair of left and right surround speakers 26 and 28 spaced from the sides of the listening station to provide a sense of spaciousness to sound radiated by the speakers, and providing ambient sounds for AV programs such as movies and concerts. Also included in the system 10 are left and right back speakers 30 and 32 located generally behind and to the sides of the listening station to provide a more intense surround sound. The speakers preferably are arranged around a center line 34 passing through the AV unit 14 and the listening station 24. Although the speakers are illustrated as being mounted on stands, wall mounting is a common alternative.

The numerous loudspeakers utilized in surround sound systems such as those illustrated in FIGS. 1 and 2 require complex wiring schemes that are not only difficult to connect, but often result in complicated, time-consuming installation procedures, where wires must be run through walls or ceilings from the AV source to the remote speakers, or unsightly installations where wires are simply left on the floor or are strung along wall surfaces. In accordance with the speaker system of the present invention, as generally illustrated at 50 in FIGS. 3 and 4, these issues are obviated by providing a surround sound loudspeaker system in a single enclosure 60 which replaces the speakers 26, 28, 30 and 32 of prior surround sound systems. Speaker system 50 replicates the sound patterns of prior loudspeaker systems while avoiding installation problems through the use of a wireless connection between a transmitter 62 at the AV source 14 and a corresponding receiver and amplifier illustrated at 64 at the loudspeaker enclosure 60. The wireless surround speaker system 50 is a compact unit that may be placed unobtrusively behind the listening area 24, on the floor, on a table or on a shelf, for example, while creating an enveloping, realistic surround-sound performance.

The loudspeaker system enclosure 60, in one embodiment illustrated in FIGS. 5-9, includes a downwardly-facing woofer 66 and a pair of laterally-spaced left and right channel controlled directivity loudspeaker arrays 68 and 70. Each of these controlled directivity arrays may consist of a pair of loudspeakers such as the speakers 72 and 74 in the left channel array 68 and speakers 76 and 78 in the right channel array 70. It will be appreciated by those having skill in the art that more than two loudspeaker drivers or transducers may comprise the multi element, opposed controlled directivity arrays for appreciably higher directivity. Similarly, the current embodiment of the invention preferably includes a woofer or single low-frequency transducer 66 but multiple low frequency transducers may be employed.

Figure 9:
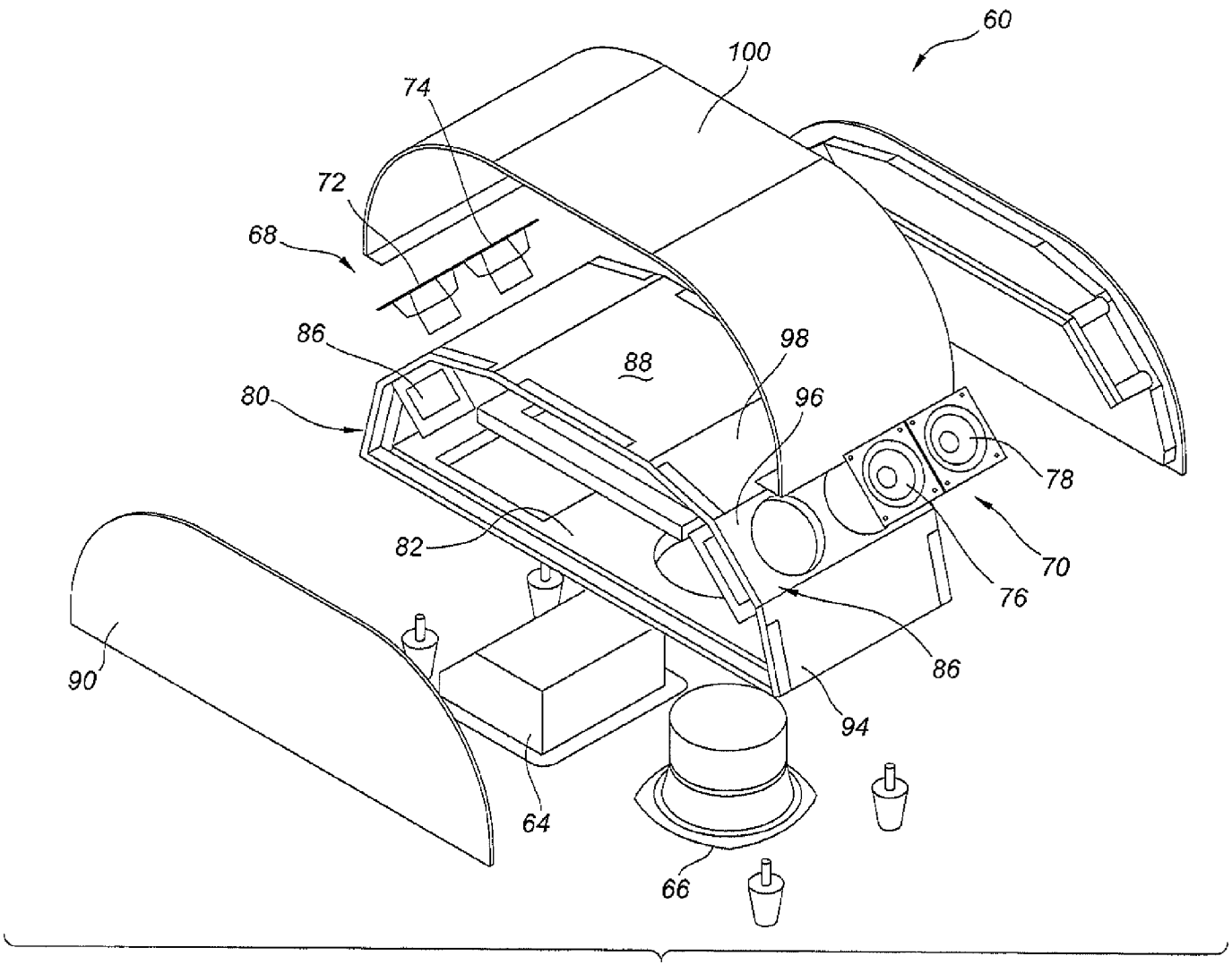
FIG. 9 is an exploded view of the enclosure of FIG. 5.

As best seen in the exploded view of FIG. 9, enclosure 60 may include a support frame 80 having a base, or floor 82 in which the woofer 66 is mounted, left and right end walls 84 and 86 which carry the respective left and right controlled directivity arrays 68 and 70, a top wall 88, and front and back walls 90 and 92. The walls of enclosure 60 (i.e., base, or floor 82, left and right end walls 84 and 86, a top wall 88, and front and back walls 90 and 92) are all preferably fabricated or molded from substantially rigid or acoustically inert materials such as MDF, polymer or a laminate or composite thereof. The end walls are preferably sloped inwardly and upwardly to form an angle $\Psi$ with the floor 82, where $\Psi$ is 45°, so that the supported speaker arrays project at that angle from the base of the enclosure. The lateral separation of the arrays may vary, depending on the expected wavelengths to be radiated, and, as illustrated, the end walls may be segmented to incorporate end panels, such as panels 94, 96 and 98, that are angled with respect to each other to provide a rounded appearance to the enclosure. A grill or cover 100 completes the exterior of the enclosure. The top surface and angled ends of the loudspeaker system grill or cover 100 are preferably made from a substantially acoustically transparent material so that first loudspeaker array 74 and second loudspeaker array 76 can project sound upwardly and laterally through the opposing curved ends and into the listening room 12.

In one embodiment of the invention, the speaker system 50 incorporates a 5.25 inch woofer 66 and four 2.5 inch full-range drivers 70, 72, 74 and 76 powered by the compact multichannel receiver and amplifier 64 and are driven to produce a controlled dispersion of the sound by filter circuitry to be described. In use, the single enclosure multi-surround channel loudspeaker system enclosure 60 is positioned in room 12 (see FIG. 3) to the rear of the listening area 24. The opposing left and right channel loudspeaker arrays 68 and 70 of the enclosure are oriented towards opposing lateral reflecting surfaces, such as side walls 120 and 122 on opposite sides of the viewing axis 34 of the room in which the system is located, so that the sound is projected outwardly from the enclosure toward the reflecting surfaces and is reflected back toward the listening area 24, as illustrated, for example, by the dashed lines 124, 126, 128 and 130 in FIG. 3. This reflected radiated sound from the filtered output of speaker system 50 is perceived by a listener as being produced by a pair of spaced sources that gives the illusion of a surround sound system. These apparent sources may be referred to as phantom left and rear speakers and are derived from digital filters and signal processors that incorporate psycho-acoustic techniques to be described.

Figure 10A:
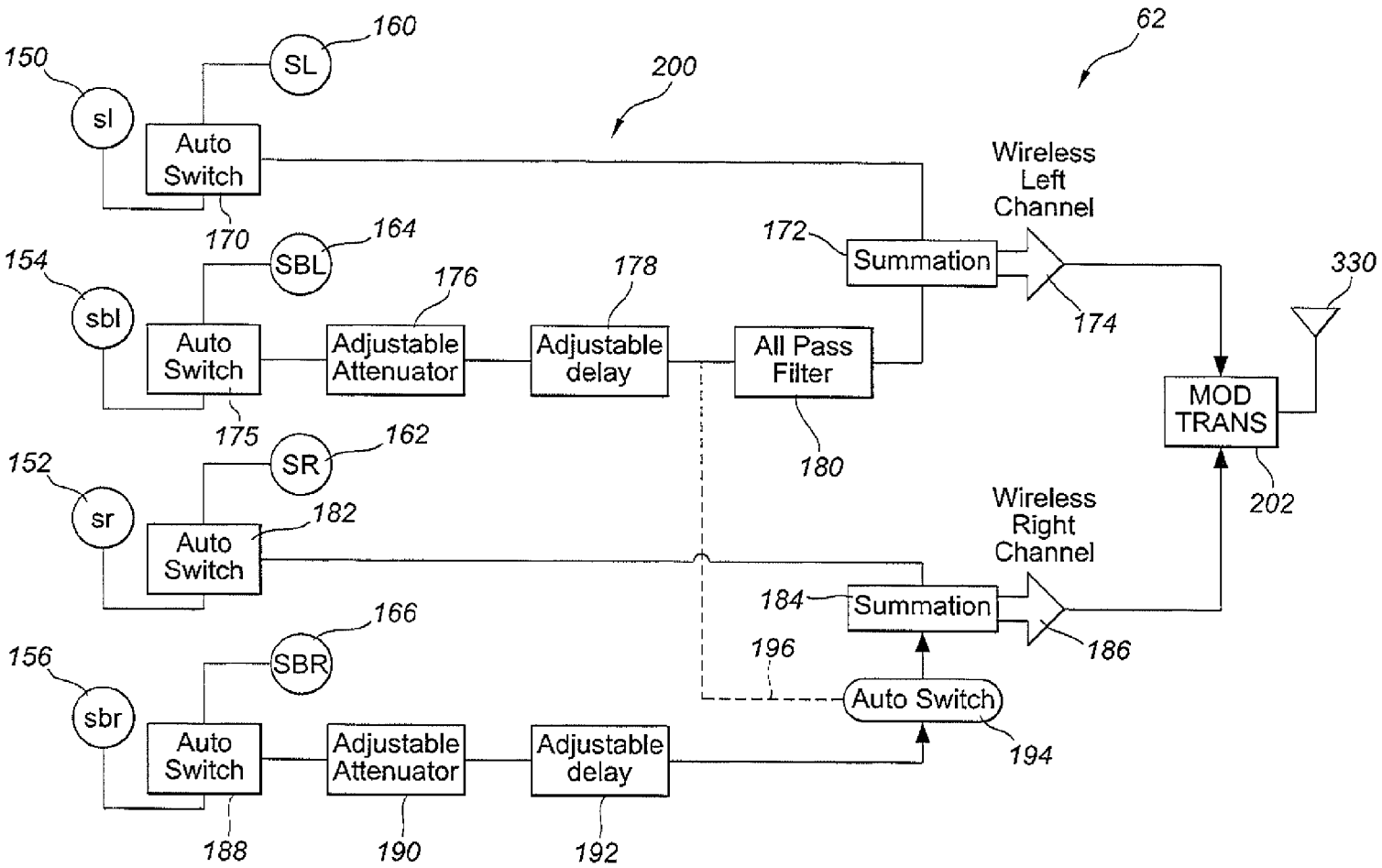
FIG. 10A is a block diagram illustrating the transmitter unit of FIG. 4.

In the illustrated embodiment of the invention, surround channel program material is pre-processed by an integrated wireless transmission interface module 62 that includes circuitry programmed to perform digital signal processing and channel mixing steps in advance of wireless surround signal broadcast to the wireless surround signal receiver 64. The transmitter portion of the wireless embodiment of the invention included in the surround signal interface transmitter module 62, illustrated in block diagram form in FIG. 10, is connected to output terminals of the A/V unit 14 to wirelessly transmit audio signals from the A/V unit to the remote surround sound speaker system 60. Such A/V units typically incorporate left and right channel audio output terminals (not shown) which are connected to respective left and right channel line level or speaker level transmitter input terminals on the transmitter module 62. The transmitter module line level input terminals are identified in FIG. 10A as left surround ("sl") channel 150, right surround ("sr") channel 152, left rear surround ("sbl") channel 154, and right rear surround ("sbr") channel 156. The A/V unit may include alternative left and right channel speaker level outputs which may be used instead of the line level outputs, and these are connected to alternative speaker level transmitter module input terminals which are identified in FIG. 10A as left surround ("SL") channel 160, right surround ("SR") channel 162, left rear surround ("SBL") channel 164, and right rear surround ("SBR") channel 166. Only one of the line level or alternative speaker level sources should be used at any one time in order to minimize interference. Thus, an AV unit (e.g., 14) provides line level or speaker level sources for the following "surround" signals: "SR" (right surround), "SL" (left surround), "SBR" (right rear or back surround), and "SBL" (left rear or back surround).

In order to provide the desired directional effects at the remote speakers in enclosure 60, the A/V output signals supplied to the transmitter module are "characterized", or digitally filtered and mixed, before being supplied to the loudspeakers. This filtering can be done either at the transmitter module 62 before the audio signals are modulated and transmitted, or can be accomplished at the remote speaker system after reception and demodulation, for example at the receiver/amplifier 64 in the remote enclosure 60. For purposes of this disclosure, the digital filter network of the invention will be illustrated as being incorporated within or located at the transmitter 62, although it will be understood that digital filtering can be incorporated elsewhere.

In accordance with an exemplary embodiment of the invention as illustrated in FIGS. 10, 11, 20 and 21, the audio signals from the A/V unit are filtered by connecting the left channel line level source terminal 150 (or the speaker level source terminal 160) through an optional automatic switch 170 to a summing network 172 which feeds a wireless left channel output 174. The left channel line level rear source terminal 154 (or speaker level terminal 164) is connected through optional automatic switch 174, adjustable attenuator 176, adjustable delay network 178 and all pass filter 180 to the left channel summing network 172 and thence to left channel 174. The right channel is similarly connected, with the right channel line level terminal 152 (or the speaker level terminal 162) being connected through an automatic switch 182 and through a right channel summing network 184 to a wireless right channel output 186, and the right channel line level rear source terminal 156 (or speaker level terminal 166) being connected through automatic switch 188, through adjustable attenuator 190, adjustable delay 192 and automatic switch 194 to the summing network 184 and thence to right channel output 186. The output of delay circuit 178 is connected to an input 196 of switch 186 in order to shift the delayed outputs between the left and right channels.

Figure 10B:
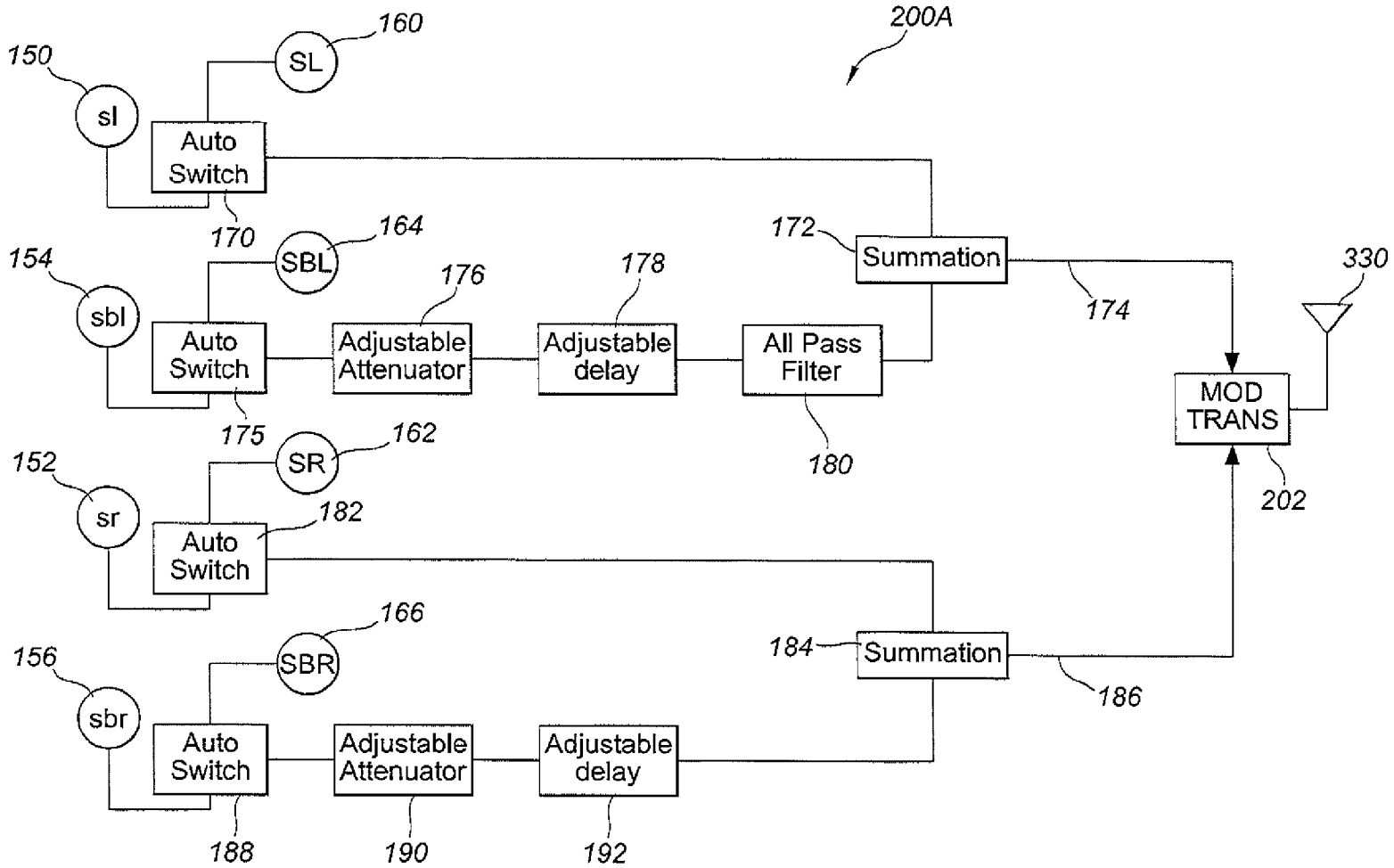
FIG. 10B is a block diagram illustrating an alternative embodiment of the transmitter unit of FIG. 4.

In one embodiment of the invention, the adjustable ranges of the attenuators 176 and 190 of this filter network, generally indicated at 200 on FIG. 10A, were from −20 dB to 0 dB, with a 1 dB resolution, while the adjustable range of the delays 178 and 192 were from 10 ms to 30 ms. In operation, if there is a left channel rear audio signal at the output of delay network 178, auto-switch 194 is turned off, and the left channel delayed rear signal is added to the left undelayed signal at summing network in the left channel. At the same time, the right channel carries only the undelayed surround signal from terminal 152. On the other hand, when there is no output signal from delay network 178, then auto-switch 194 is turned on, and the right channel output at 186 includes the audio from right terminal 152 and the delayed and filtered rear audio signal from terminal 156, as summed at network 184. The left and right channel signals from the filter network 200 are supplied to an RF modulator/transmitter 202 which wirelessly transmits the filtered audio signals to the remote receiver 64. Alternatively, as shown in FIG. 10B auto-switches such as Switches 170, 175, 182 and 188 may be omitted; in early prototypes, the auto-switches were intended to detect the presence of signal at the line-level and speaker-level inputs and to switch to whichever is active; later prototypes have removed them. Line 196 is Surr. Back Left signal that is cross mixed into the right channel output in advance of the all-pass filter (180) to ensure phase coherent SB reproduction. The purpose of delays 178 and 192 is to increase latency of the SB channels so as to ensure that SL and SR effects arrive first and thereby provide appropriate spatial lateral cues (in accordance with the precedence effect) to the extent that SL/SR and the SB channels share common signal content, as is often the case. Conceptually, one may characterize the processing as follows: Wireless Left=SL+SBL (with delay, attenuation and all-pass filtering applied to SBL) and Wireless Right=SR+SBR (delay, attenuation applied to SBR). Thus FIGS. 10A and 10B (as shown) show topologies which are compatible with 6.1 channel surround systems, whereby there is a single SB channel. Such systems are no longer widely commercially available, hence the decision to remove switches 196 and 194 in the embodiment of FIG. 10B.

Figure 3:
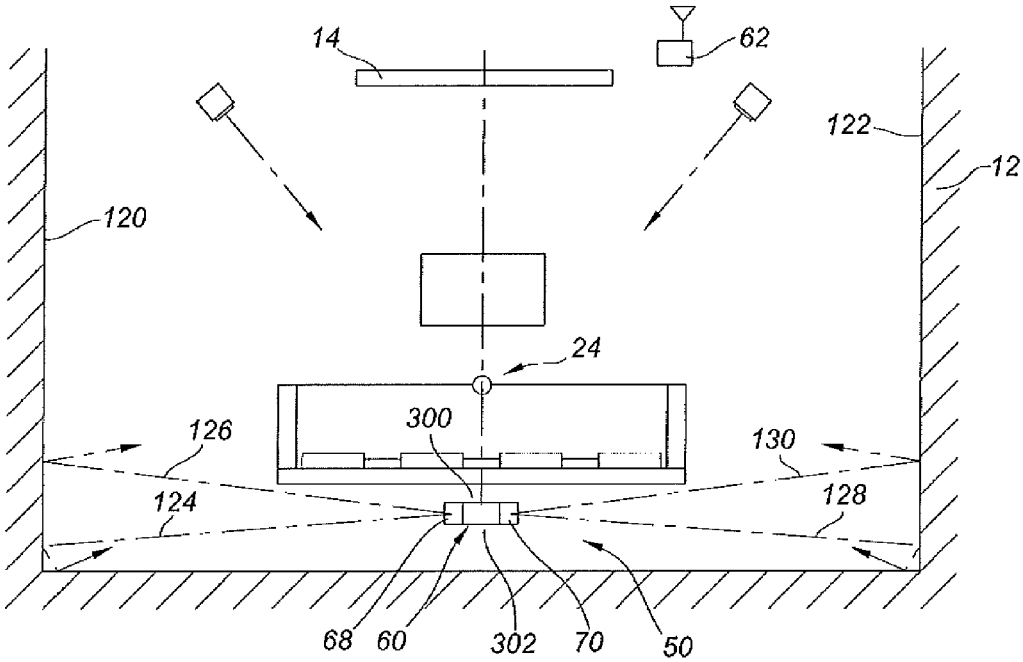
FIG. 3 is a diagrammatic illustration of a wireless audio surround sound system in accordance with a preferred form of the present invention.
Figure 4:
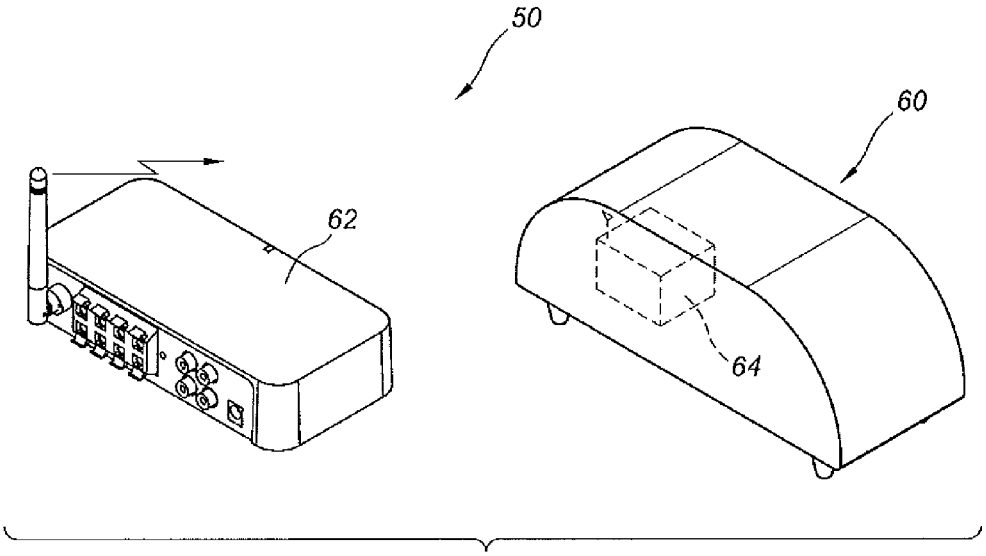
FIG. 4 is a diagrammatic illustration of a transmitter unit and a loudspeaker enclosure utilized in the system of FIG. 3 and incorporating the present invention.
Figure 5:
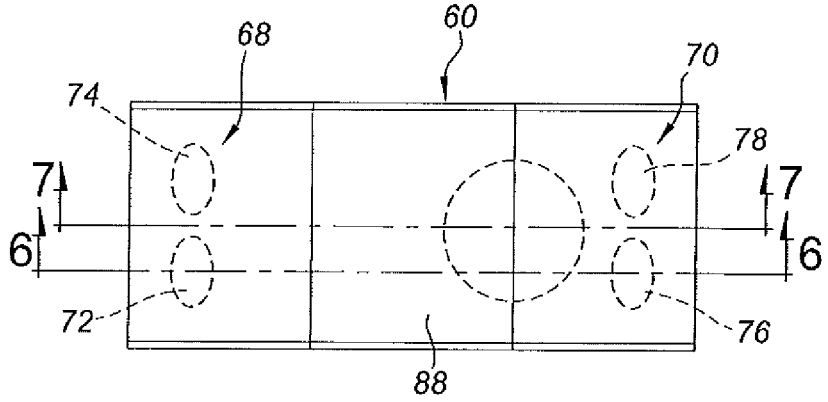
FIG. 5 is a top plan view of the single enclosure surround sound loudspeaker system of the present invention, showing left and right channel loudspeaker arrays.
Figure 6:
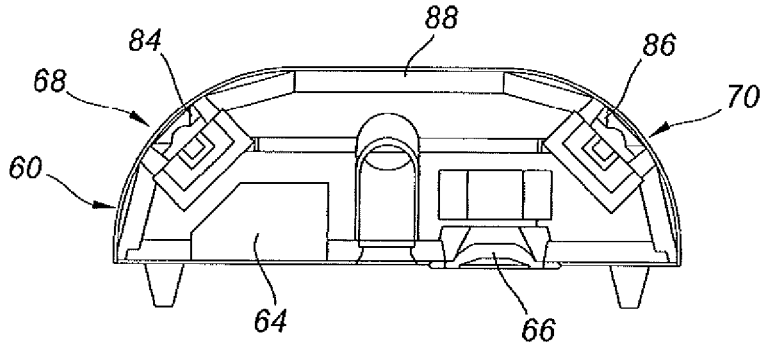
FIG. 6 is a cross section of the enclosure of FIG. 5, taken along line C-C.
Figure 7:
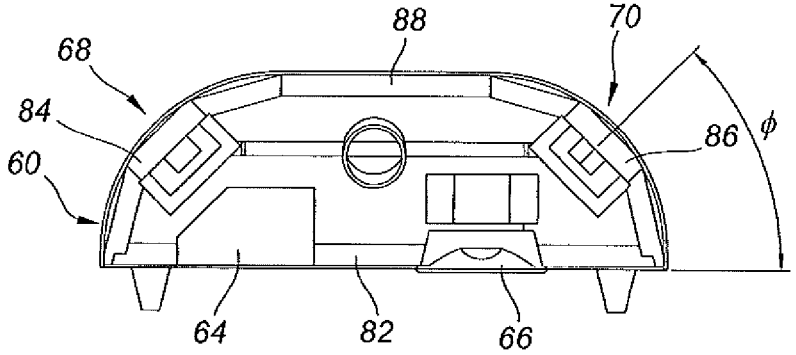
FIG. 7 is a cross section of the enclosure of FIG. 5, taken along line A-A.
Figure 8:
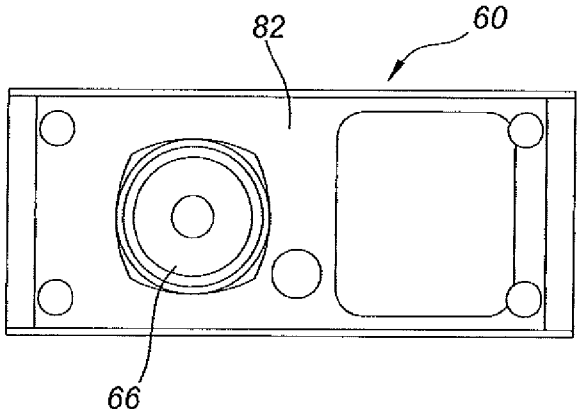
FIG. 8 is a bottom view of the enclosure of FIG. 5.

The parameters for the attenuators and delay portions of the filter network 200 are selected in accordance with psychoacoustic considerations, to divide the surround sound signals produced by the A/V unit and to characterize them by attenuating and mixing them in such a way as to produce radiated acoustic signals from the loudspeakers that produce the effect of phantom surround-sound speakers for a listener when the system is configured as illustrated in FIG. 3. The remote speaker system, as described above, incorporates the single enclosure multi-surround channel loudspeaker system 60, where the several loudspeaker transducers are driven by dedicated amplifiers connected to the wireless surround signal receiver 64, which is illustrated in block diagram form in FIG. 11. Received RF signals from the transmitter 62 are demodulated at 210, and the resulting left and right channel signals at demodulator outputs 212 and 214 are supplied to selected amplifiers and loudspeaker drivers.

Preferably, the signal processing associated with generation of psycho-acoustic cues (specifically for elevation) occurs in the RX device's DSP. Filter network 200 (i.e., the network within the transmitter itself) mixes the four discrete surround and surr-back signals down to 2 channels before wireless transmission (limited to 2 channels of wireless transmission). The "effects" of 200, which amount to time delay of the SB signals and an all-pass filter on SBL, are clearly different than the generation of psycho-acoustic cues for elevation which occur in DSP 280. The only thing psycho-acoustic about 200 is the time delay on the SB channels which helps to prevent localization to the speaker by ensuring that the arrival of SL and SR effects precede SB effects.

Figure 11:
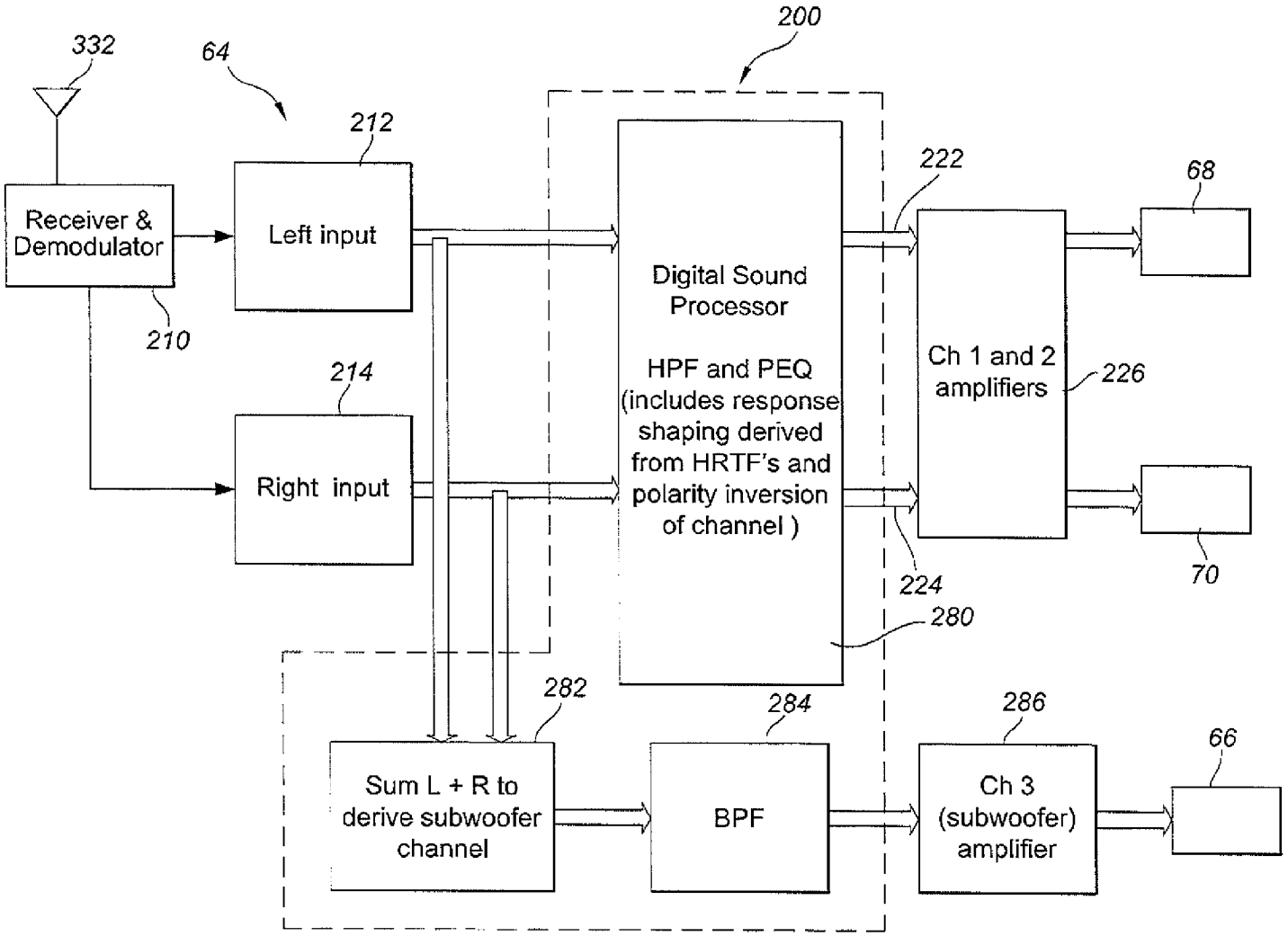
FIG. 11 is a block diagram illustrating the circuitry in the speaker enclosure of FIGS. 5-9.

As illustrated in FIG. 11, additional signal processing in a processor circuit 220 preferably is provided for the left and right channel signals 212 and 214 to generate surround baseband signals which then are supplied at outputs 222 and 224 to left and right channel power amplifiers, generally indicated at 226, which then drive the left and right loudspeaker arrays 68 and 70. This signal processor circuit 220 is used to produce additional magnitude response shaping for the audio output waves radiated by the speaker arrays, in part to provide in the radiated waves and their reflections from the media area 12 the psycho-acoustic cues that are appropriate for both delocalization of the actual audio source position (enclosure 60) and for localization to the preferred phantom source positions perceived by a listener. This magnitude response shaping, along with the digital filtering discussed above, occurs in advance of the power amplifiers within the loudspeaker system's enclosure 60 to not only produce the phantom speakers already described but to accommodate the loudspeaker array radiated outputs to different locations of the enclosure 60, so it may be placed on the floor, on a table or on a shelf behind the listening position, as described with respect to FIG. 3.

To accomplish this, the processing circuit 220 incorporates multiple, for example, three, magnitude response shaping sets in accordance with appropriate head related transfer function ("HRTF") ratios (or HRTFs) for multiple placement options of the loudspeaker system enclosure 60. The HRTFs serve to model and predict the effects of acoustical constructive and destructive interference associated with the ear pinnae shape, and with torso reflections, in the measured acoustic response at the opening of the ear canal of a listener, or test subject, normalized to acoustic response in the physical absence of a test subject (ear/pinnae/torso), and this response is replicated by the processing circuit 220.

Figure 12:
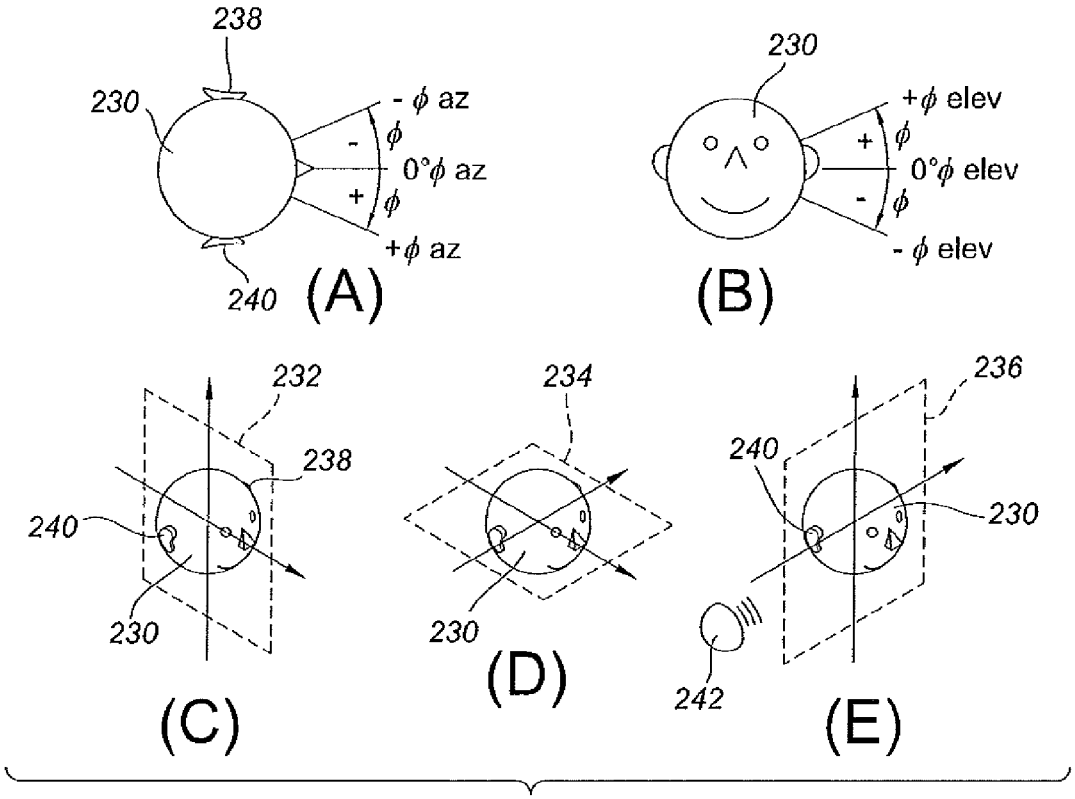
FIG. 12 is an illustration of a spatial coordinate system for Head Related Transfer Functions (HRTF)
Figure 13:
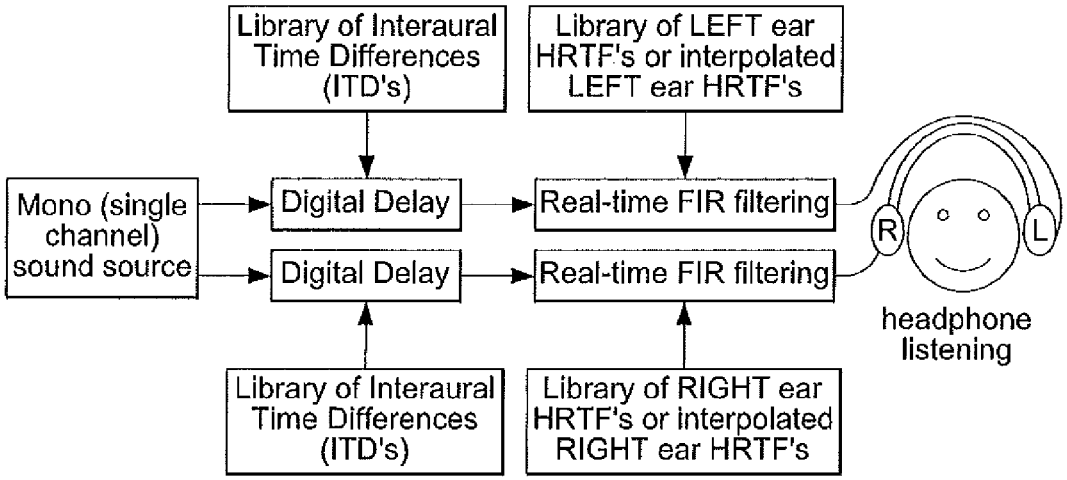
FIG. 13 is a block diagram of a simple HRTF based spatial sound synthesis system.

As illustrated in FIGS. 12 and 13, the head related transfer functions used in the present invention are derived by, among other things, measuring sounds heard by a listener based on the location in space of the sound source relative to a listener 230. FIG. 12 illustrates at (A) through (E) the azimuth (FIG. 12A) and elevation (FIG. 12B) relationships of spatial measurements of sound levels with respect to the listener. As illustrated with respect to median, horizontal and vertical planes 232, 234, and 236 of FIGS. 12C, 12D and 12E, respectively, the left ear 238 is located at approximately −90° azimuth and 0° elevation, while the right ear 240 is located at +90° azimuth and 0° elevation. In making psycho-acoustic measurements of sound at the listener, time delays due to the length of time sounds of various frequencies from a given source location take to reach one ear and then the other ear are measured. A sound source 242, located, for example, to the right side of a listener (FIG. 12 E) reaches the right ear 240 (the ipsilateral ear) at a measurable time before it reaches the left ear 238 (the contralateral ear).

As illustrated in FIG. 13, in order to produce desired surround sound effects using psycho-acoustical techniques, libraries 250 and 252 of left and right ear interaural time differences (ITDs) and libraries 254 and 256 of left and right ear HRTFs (or interpolated HRTFs) are established. These can then be used to filter, or shape, the audio signals in a processor to create the illusion of surround sound, as through headphones 260, from a source such as monaural source 262 by supplying the source sound through left and right channels 264 and 266, through respective left and right digital delay circuits 268 and 270 and through respective left and right real time FIR filters 272 and 274 to the left and right sides of the earphones. The digital delays 268 and 270 are controlled by the libraries 250 and 252, respectively, and the filters 272 and 274 are controlled by the HRTF libraries 254 and 256, respectively, to generate in the headphones the desired sounds that will replicate the desired surround sound effects.

Figure 14:
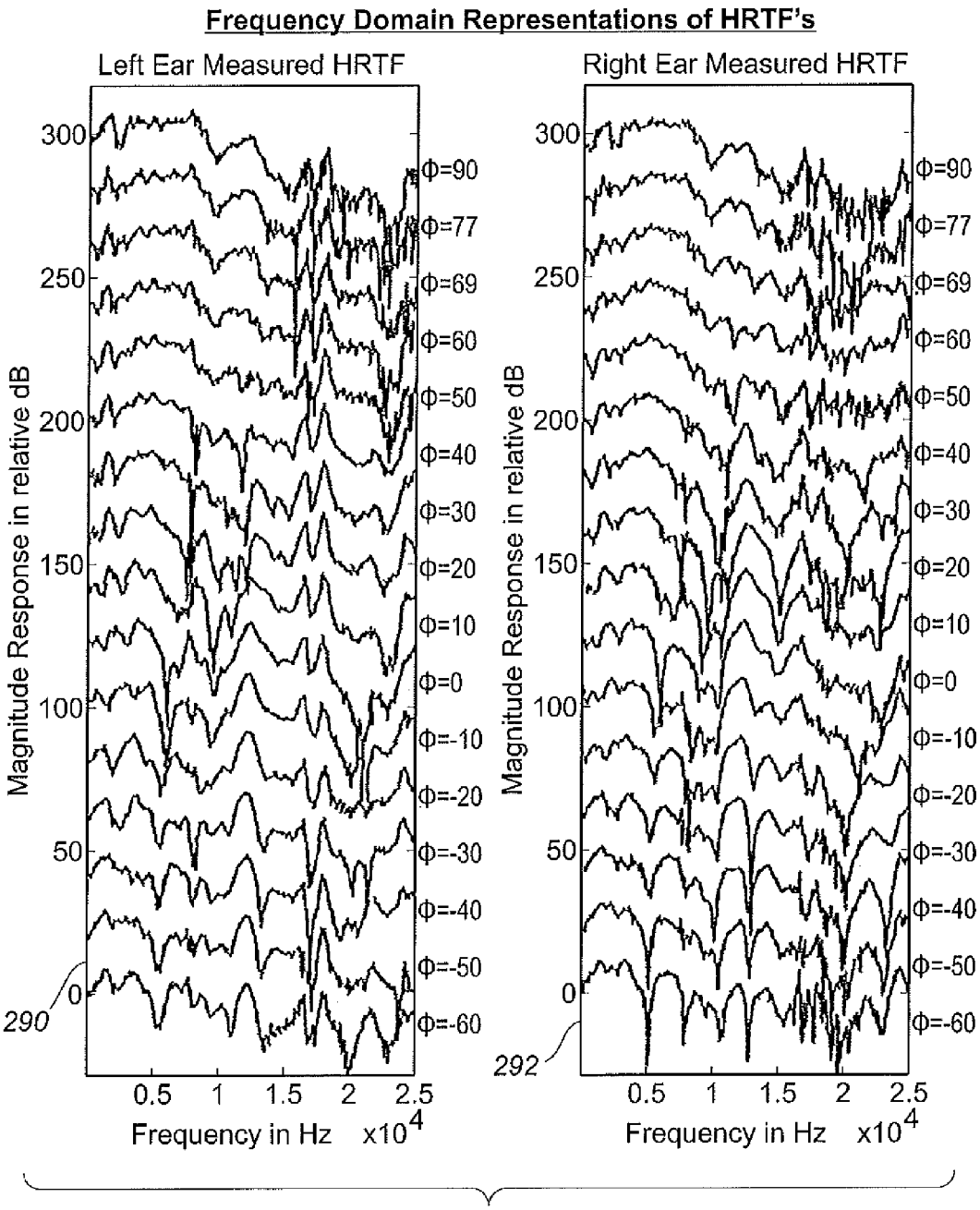
FIG. 14 is a graphical illustration of a frequency domain comparison of measured HRTF's as a function of elevation angles in a median plane for angles ranging from −60 degrees to +90 degrees.

FIG. 14 illustrates left and right ear measured frequency domain representations 290 and 292, respectively, of head related transfer functions (HRTFs) in the median plane (azimuth=0) as a function of elevation angles, ranging from −60° (60 degrees below ear level) to +90' (directly overhead). Left and right ear measurements are theoretically identical for a given elevation, but the illustrated complex structure of the measured HRTFs reflects the variations that are caused by pinna and torso interactions that occur with a listener rather than a theoretical spherical listener station.

These same HRTF measurements are used to establish in the processor 220 audio signal shaping so that the signals that drive the loudspeaker arrays are perceived as being surround sound signals at desired phantom speaker locations. In the processor of the present invention, processor 220 utilizes a digital sound processor having HRTF processing to provide response shaping of the left and right channel inputs 212 and 214 to produce in the radiated acoustic outputs of the loudspeakers 68 and 70 the appropriate localization cues for producing the desired phantom speaker effects for different elevations of the loudspeakers. As also illustrated in FIG. 11, left and right channel audio signals 212 and 214 are also supplied to woofer 66 through summing network 282, through band pass filter 284, and amplifier 286. The described signal processing is most conveniently performed in the digital domain, but analog-to-digital and digital-to-analog converters are omitted from this Figure for clarity.

The processing circuitry 280 enables a listener to recognize a phantom source as being located at an elevation of, for example, 60° above a horizontal plane when the actual source, such as the enclosure 60, is positioned somewhere below the horizontal plane, as, for example, when the actual sound source 60 is placed on the floor of the listening room. In such a case, a realistic surround sound would require elevation of the apparent, or phantom, sound source from approximately −60 degrees to +60 degrees for a seated listener, and so would involve a listener-perceived response shape that is different than the shape that would be associated with a table height placement (−20 degrees to +60 degrees) of the loudspeaker enclosure 60. The different response shapes are caused by the differing HRTFs associated with the floor and table placement options.

Figure 15:
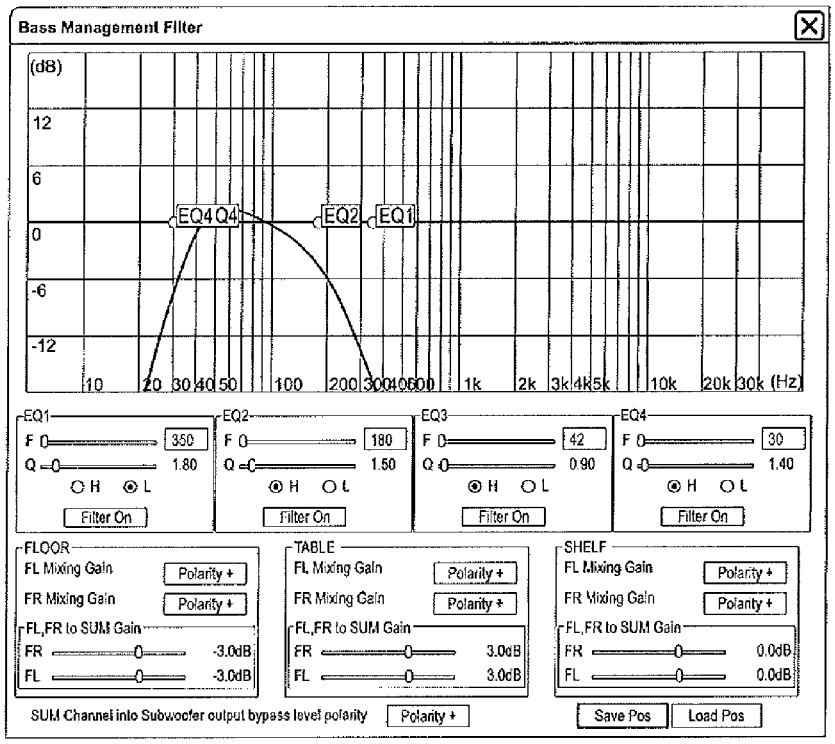
FIG. 15 is a screen shot of a DSP Graphic User Interface providing a graphic illustration of subwoofer response shaping as well as relative polarity settings for Left and Right speakers of the enclosure of the present invention.
Figure 16:
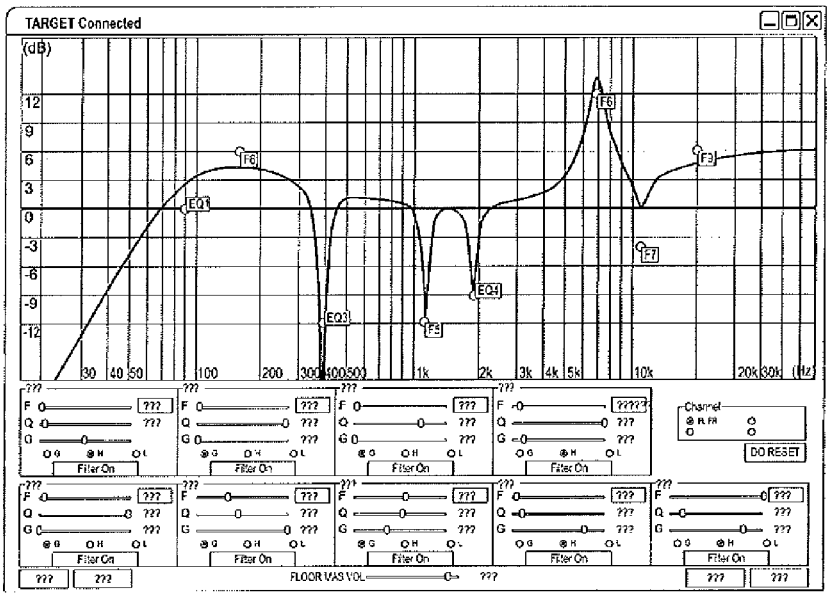
FIG. 16 is a screen shot of a DSP Graphic User Interface providing a graphic illustration of response shaping for a floor position of the enclosure of the present invention.

FIGS. 15 and 16 illustrate how the frequency and phase (time delay) of each surround channel's signal can be adjusted using HRTF models to generate the amplified surround signal used to energize the opposing arrays 74 and 76 in order to generate convincing phantom sources which, from listener position 24, appear to be coming from the traditional surround loudspeaker locations illustrated in FIGS. 1 and 2. FIG. 15 is a graphical display, taken from a DSP Graphic User Interface, of the response shaping for woofer 66 provided by the processor 220 (FIG. 11), showing the relative polarity settings for the full range, or high-passed channel (FIG. 10). FIG. 16 shows the response shaping for a floor position setting, as displayed in Graphic User Interface of DSP software. The graph shows a prominent peak at 7 kHz that helps to provide spatial cues for elevating the apparent location of the loudspeaker as a sound source, while other aspects of the sound shaping help to compensate for the native acoustic response of the loudspeakers.

Figure 17:
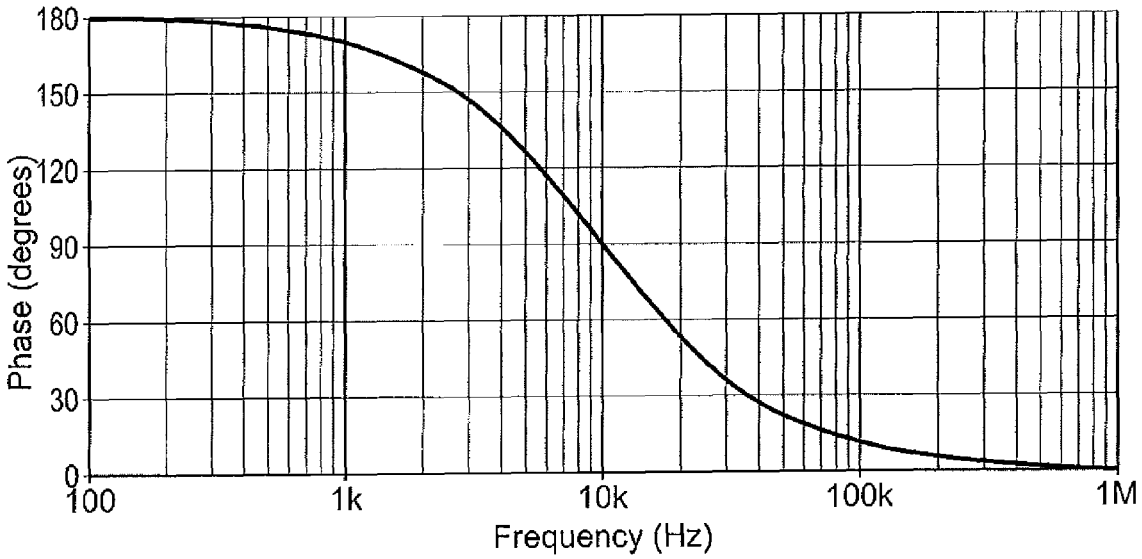
FIG. 17 is a graph of the phase response of an all-pass filter having a corner frequency of 10 kHz.

Referring again to the transmitter unit 62 illustrated in FIG. 10, it is noted that the all pass filter 180 may be a combination of high-pass and low-pass filters with polarity inversion of the two high-passed signals that are to be transmitted to the opposing two-element arrays 68 and 70. FIG. 17 is a graphical illustration of the phase response of the all-pass filter, wherein the filter has a corner frequency of 10 kHz. It is noted that the corresponding magnitude response would appear as a flat, horizontal line indicating uniform (or unity) gain through the filter's entire pass band.

The polarity inversion produced by the filter circuit of the invention ensures that surround sound radiation previously directed towards the listener's seating area 24 by the SL and SR speakers 26 and 28 of prior systems (FIG. 2) will be suppressed due to destructive interference whenever the surround left and right channels share common information. In other words, the combined radiation pattern of the two loudspeaker arrays 68 and 70 is dipolar in nature for these signals and produces null regions 300 and 302 (see FIG. 18) along the fore/aft axis 34 of the listening space. The left and right signals for Surround Back (SBL and SBR) channels, supplied to speakers 30 and 32 in the prior art arrangement of FIG. 2, are pre-filtered for polarity inversion above the phase turnover (crossover) frequency of all-pass filter 180, so that phase inversion within the receiver signal path ensures phase coherence of the Surround Back channels. As illustrated in FIG. 19, the radiation pattern associated with the surround back channels is approximately monopolar and substantially Omnidirectional, as indicated by lateral radiation 126 and 128, and by front and back radiation 304 and 306, thus providing relatively more direct sound into the seating area 34. Delayed relative to the lateral surround channels represented by speakers 26 and 28 (SL and SR), auditory cues originating directly from enclosure 60, in addition to the reflected sounds, support proper localization of any discrete rear surround effects.

Thus, the single enclosure multi-surround channel loudspeaker system 60 generates or creates the sonic illusion (or phantom sound) simulating playback from conventional separate, elevated surround loudspeakers which each reproduce a unique surround channel program material (e.g., SL, SR, SBL and SBR as illustrated by speakers 26, 28, 30 and 32 in FIG. 2). A plurality of elevated phantom sound sources are generated by the enclosure 60, as perceived by a listener at the listening position 24 in accordance with the present invention, irrespective of where enclosure 60 is placed, whether it be on the listening room's floor, on a table or on a high shelf. As a result, the single enclosure multi-surround channel loudspeaker system of the present invention replaces multiple conventional surround channel loudspeakers, and is versatile in its various uses in that it can be placed in multiple locations, and is forgiving of what would otherwise be poor speaker enclosure placement decisions.

Figure 20:
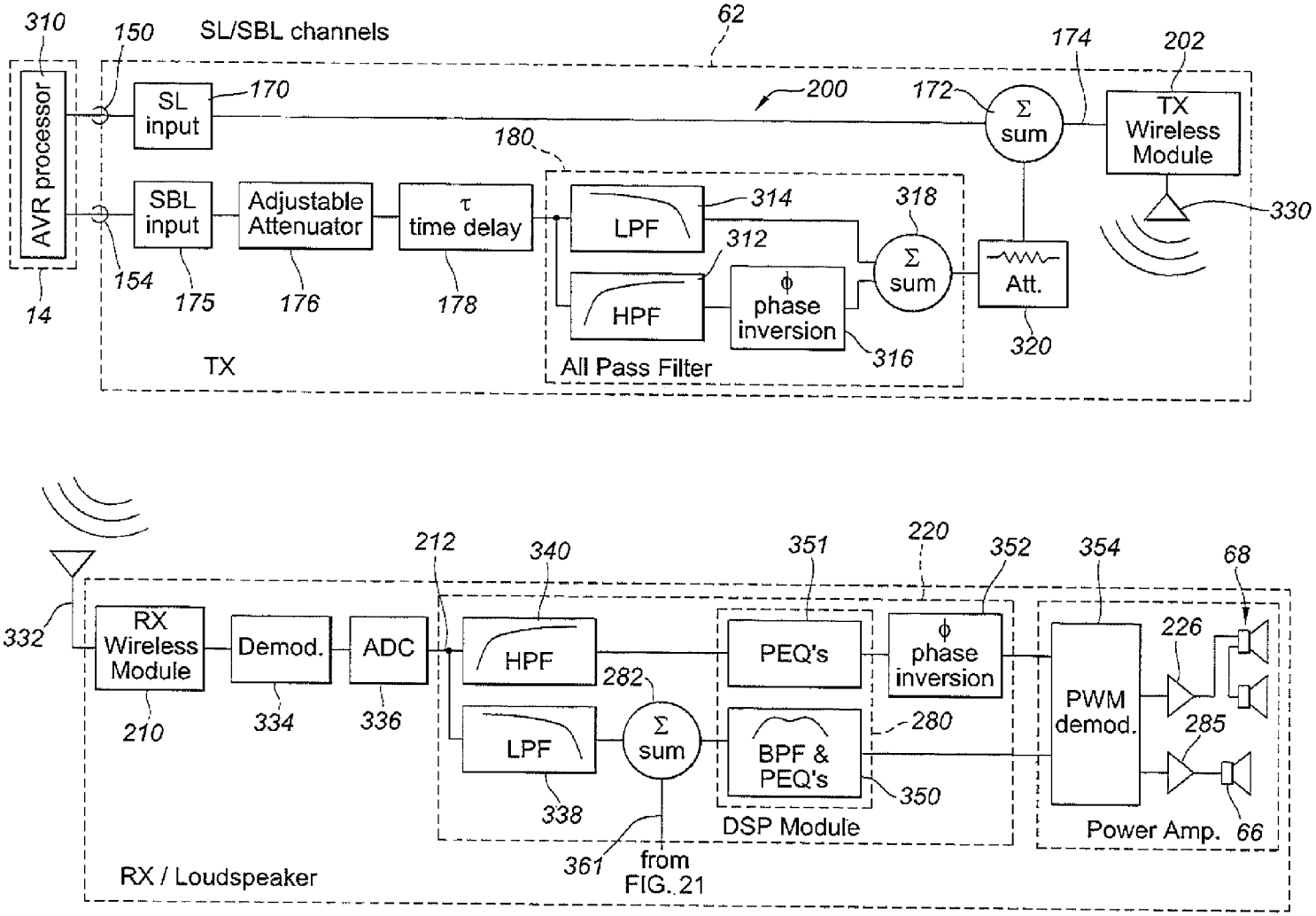
FIG. 20 is a block diagram of the transmitter and speaker enclosure receiver circuitry for the left surround channel and the woofer of the system of the present invention.
Figure 21:
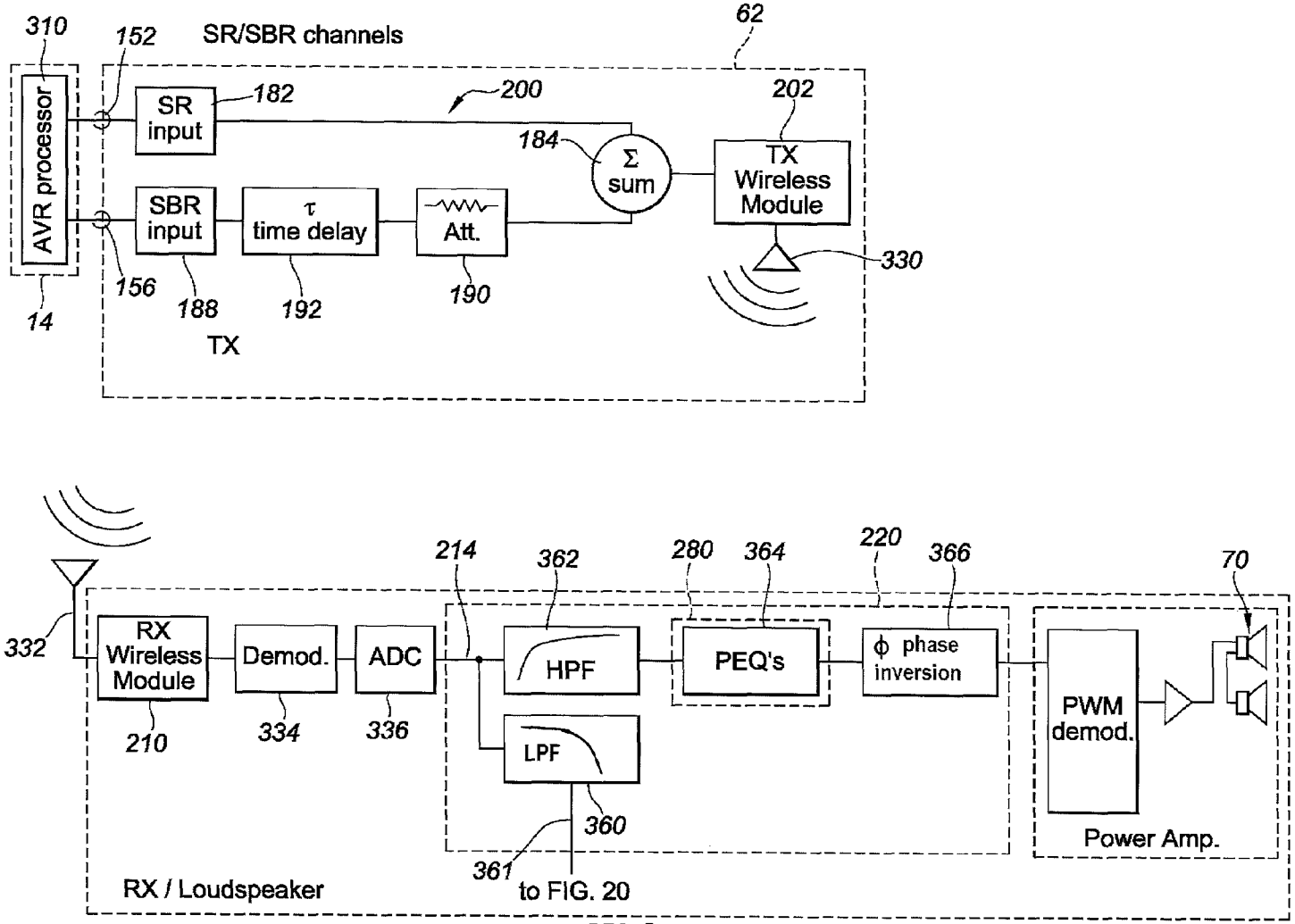
FIG. 21 is a block diagram of the transmitter and speaker enclosure receiver circuitry for the right surround channel of the system of the present invention.

Both the method of simulating surround sound performance from a single loudspeaker enclosure and apparatus for carrying out the method, are summarized in FIGS. 20 and 21, to which reference is now made. These Figures illustrate the transmit and receive components of FIGS. 10 and 11 in greater detail, and common elements are commonly numbered. Embedded in the host A/V unit 14 is a sound processor 310 for connecting Surround Left (SL) and Surround Back Left (SBL) channels to terminals 150 and 154 of the transmitter unit 62. These terminals are connected to corresponding input switches 170 and 175 of the filter network 200 and the SL input at 170 is fed directly to summing network 172. The Surround Back Left (SBL) signal is fed through input switch 175, adjustable attenuator 176 and adjustable time delay 178 to all-pass filter 180. The all-pass filtering is achieved via summed high-pass and low-pass filters 312 and 314, with the high-pass filter output being phase inverted at 316 and summed at 318 to the low-pass filter output. Inverter 316 effectively inverts phase above a designated "corner" frequency at which a phase shift of 90 degrees occurs, as illustrated in FIG. 17.

The SBL signal from summer 318 may be attenuated at 320 and summed, or mixed, with the SL signal at 172, with the combined signal at 174 then passing through wireless transmitter (TX) module 202, terminating with the transmitter's antenna 330 from which it is broadcast to the wireless receiver (RX) module 210, illustrated in FIGS. 11 and 20, itself integrated with a directional antenna 332. The transmitter preferably is an RF generator modulated in a 44.1 kHz/2.4 GHz format.

The received mixed SL/SBL left channel signal is demodulated at demodulator 334 and converted into the digital domain at ADC converter 336. This digital signal is supplied to the Digital Sound Processor (DSP) 220, also illustrated in FIG. 11, within which a low-pass filter 338 (FIG. 20) is provided for deriving the "subwoofer" signal (also known as bass allocation), which is fed to the summing network. These low-passed signals are mixed with the low-passed SR/SBR signals in network 282, as described with respect to FIG. 11, and are supplied to the dedicated "subwoofer" transducer 66, after being shaped in filters 350 of processor 220 in accordance with desired acoustic magnitude response wave shapes for the subwoofer, taking into account its performance characteristics and limitations (e.g. diaphragm excursion constraints). Received left channel signals are also supplied to a high-pass filter 340 in the processor 220, and these high-passed left channel signals are shaped in filters 351 of DSP 280 in accordance with targeted elevation-dependent head-related transfer function (HRTF) ratios, which describe how perceived magnitude response varies with source location.

For purposes of achieving the targeted audio signal response shapes, filter 351 is a series of bi-quad filters which are configured by establishing their associated parameters (frequency, HP/LP/boost/cut filter type, and filter damping characteristics or "Q") to produce shaped output audio signals in accordance with the measured psycho-acoustic cues, as discussed above. Three sets of filter parameters are provided for each of the constituent bi-quads in the high-pass signal path, and these sets are selectable, as by suitable switches on the speaker enclosure 60, so that a desired set of shaped audio signals can be selected to produce at the listening station the perception of an elevated phantom source from one of three actual placement locations ("floor", "table" and "shelf") of the enclosure.

Figure 18:
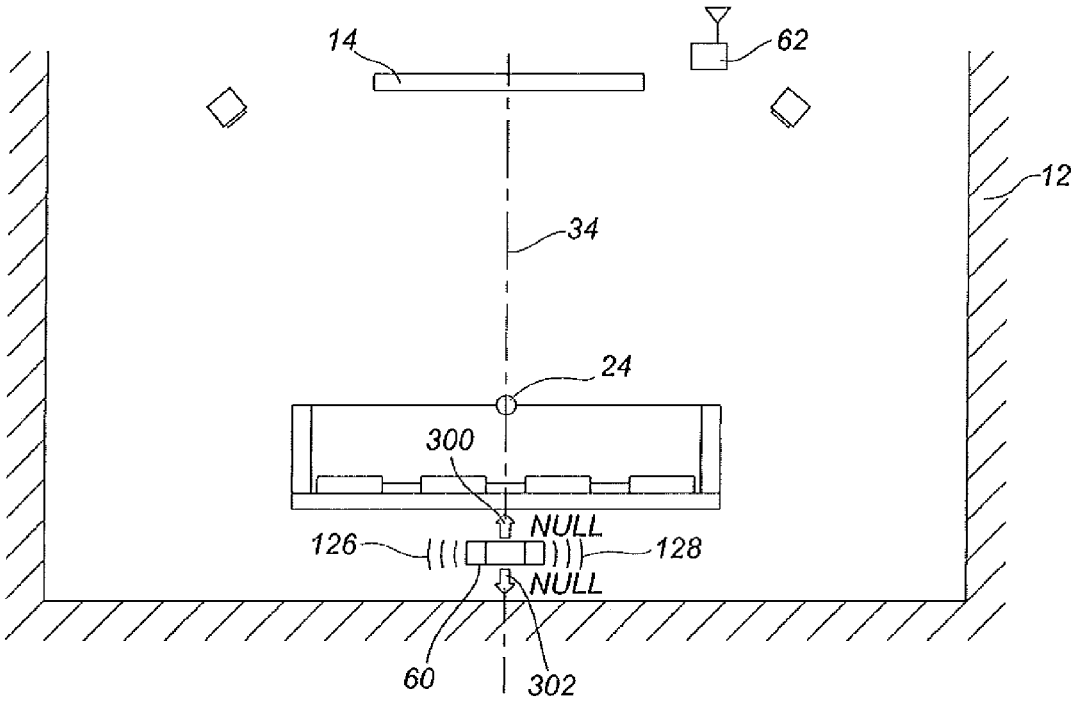
FIGS. 18 and 19 are diagrammatic illustrations of dipolar and monopolar radiation patterns, respectively, from the enclosure of the present invention.
Figure 19:
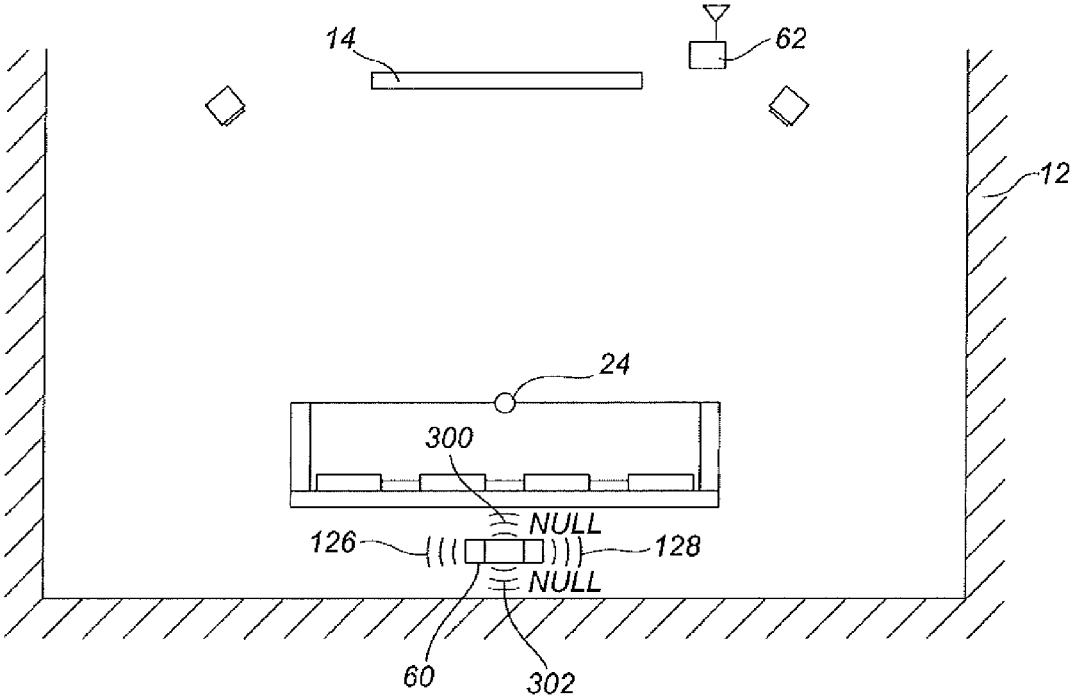

Furthermore, phase inversion of the high-passed SL+SBL signal occurs within the DSP, as at inverter 352 or elsewhere in advance of electro-acoustic transduction, to provide an acoustic null in the radiation pattern associated with surround channel reproduction to the extent that SL and SR signals are phase coherent, as illustrated in FIG. 18. By contrast, in accordance with inter-channel phase inversion of the Surround Back Left channel (relative to right channel SBR signals) in advance of transmission to the wireless receiver, SBL and SBR channels are substantially in-phase and hence radiate together in a mono-polar fashion to provide proper localization cues consistent with the loudspeaker enclosure's physical location. The output signals from processor 220 are supplied through a digital-to-analog converter 354 to left channel loudspeaker amplifier 226 to speaker array 68 and to the woofer amplifier 286 which drives woofer 66.

The signal path associated with the right audio channel is illustrated in FIGS. 10, 11 and 21. The signals in this channel are fed from the SR and SBR outputs of the connected Dolby Digital processor 310 to corresponding terminals 152 and 156 the transmitter 62, which are connected to input switches 182 and 188, respectively. The SR signals at input 182 is supplied directly to the summing network 184, where they are summed with the filtered Surround Back Right (SBR) line-level input from input switch 188. The SBR signal at switch 188 is fed through adjustable attenuator 190 and adjustable delay 192, as illustrated in FIGS. 10 and 21, to the summing network 184, and the combined, or mixed, SR/SBR signal is then supplied to wireless transmitter (TX) module 202, which terminates with the TX's antenna 330. The transmitter broadcasts to the wireless receiver (RX) module 210, itself integrated with directional antenna 332, as described above, in an RF modulated 44.1 kHz/2.4 GHz format.

The filter network 200 provides attenuation and delay of approximately 10 dB and 16 ms, respectively, for the left and right channels to ensure that localization cues associated with (lateral) SL and SR channels take precedence over SBL and SBR channel signals. In accordance with accepted psycho-acoustic principles, perceived source locations follow from first-arriving and louder sounds. So as to ensure perception of an enveloping spacious soundstage whose indistinct phantom source locations are elevated and laterally placed, the SB signals are delayed and attenuated.

The received SR/SBR signal for the right channel is demodulated at 334 and converted into the digital domain at ADC 336 to provide a right channel input 214 to the Digital Sound Processor (DSP) 280 in processor 220, as illustrated in FIG. 21. The processor includes low-pass filter 360 for deriving the "subwoofer" signal (also known as bass allocation), which is supplied via line 361 to the summing network 362 illustrated in FIG. 20. As noted above, the low-passed signals, to be reproduced by the dedicated "subwoofer" transducer 66, are summed in network 282 and are shaped in filter 350 in accordance with the desired acoustic magnitude response shape of the subwoofer, taking into account its performance characteristics and limitations (e.g. diaphragm excursion constraints). The right channel signals at 212 are also supplied to a high pass filter 362, with the resulting high passed signals being subjected to magnitude response shaping in processor 364 of the DSP 280 in accordance with the targeted elevation-dependent head-related transfer function (HRTF) ratios, which describe how perceived magnitude response varies with source location, as discussed above.

As discussed above, for purposes of achieving the targeted response shapes, the right channel filter 364 also includes a selectable series of bi-quad filters that are selected by the switches provided for the left channel filter sets, as described with respect to FIG. 20. Three sets of filter parameters (frequency, HP/LP/boost/cut filter type, and filter damping characteristics or "Q") are chosen for each of the constituent bi-quads in the high-pass signal path to provide audio outputs from the corresponding loudspeaker arrays 68 and 70 that contain psycho-acoustic cues for perception of elevated phantom sources corresponding to three actual placement locations ("floor", "table" and "shelf"). Furthermore, interchannel phase inversion of the high-passed signals is provided within the DSP or elsewhere, as at phase inverter 366, in advance of electro-acoustic audio transduction so as to provide an acoustic null in the radiation pattern associated with surround channel reproduction. By contrast, in accordance with interchannel phase inversion of the Surround Back Left channel (relative to SBR) in advance of transmission to the wireless receiver, SBL and SBR channels are substantially in-phase and hence radiate together in a monopolar fashion for purposes of providing proper localization cues consistent with the loudspeaker enclosure's physical location. Further insights on the magnitude response shaping on the "full-range" loudspeaker arrays, as indicated in FIG. 16, are provided herein below.

It will be understood from the foregoing description of preferred embodiments, the present invention provides a novel and unique system for producing, from a compact, single enclosure loudspeaker system a full surround sound that emulates a multi-location speaker system while eliminating the need for multiple speakers with their complex and often unsightly installation requirements. The single enclosure of the invention projects multi-channel surround sound into a listener's room, producing apparent, or phantom, sound sources that replace the conventional multiple surround channel loudspeakers. Loudspeaker system 50 as described herein includes a pair of opposing multi-transducer controlled directivity arrays oriented laterally toward walls or reflecting surfaces (relative to the viewing axis) within the media space 12. The multi-element controlled directivity arrays 68, 70 are housed in a single self-powered loudspeaker enclosure 60 along with a single (or multiple) low-frequency electro-acoustical drive element(s) (e.g., 66).

In one embodiment of the invention, surround channel program material is pre-processed by an integrated wireless transmission unit connected to the source of the surround sound, as, for example, a conventional A/V source. The transmission unit 62 performs certain digital signal processing and channel mixing steps in a filtering network in advance of wireless surround signal broadcast to a receiver 64. The loudspeaker system 50 further includes a wireless receiver module which passes surround signal to a second audio processor for additional magnitude response shaping, in part to provide psycho-acoustic cues appropriate for both de-localization of the actual source position and for localization to selectable phantom source positions. This magnitude response shaping, along with other audio processing, occurs in advance of on-board power amplifiers within the loudspeaker system's enclosure, and the amplifiers then drive the loudspeaker arrays to produce sound which, when reflected from surfaces in the listening area produce at the listener apparent surround sound effects from phantom loudspeakers in the listening space, or room.

It will be appreciated by persons having skill in the art that the present invention makes available a surround sound system 50 for audio installations configured by laypersons or users who are technically unskilled, but who want great sounding home theater audio playback, where the system of the present invention comprises: an audio surround sound source 62 having a filter network and a wireless transmitter for transmitting filtered left and right channel surround signals; a single transducer enclosure 60 remote from said sound source transmitter; left and right laterally spaced controlled dispersion transducer arrays 68, 70 in enclosure 60; and a receiver 64 located in enclosure 60 to receive the left and right channel surround signals and to direct those signals to respective left and right transducer arrays to radiate said surround signals which are not audibly perceived at the listening position, but which instead produce reflected or phantom sound sources, thereby generating a convenient and effective surround sound audio experience for a listener.

The DSP and other signal processing applied to the surround channel audio signals is implemented in the exemplary embodiments as part of the wireless transmitter 62 circuitry and as part of the circuitry within enclosure 60, but persons of skill in the art will appreciate that the DSP and other signal processing applied to the surround channel audio signals may be implemented entirely within enclosure 60, and that the baseband audio signals for the surround channels (150, 152, 154 and 156) may also be passed using conventional audio cables to enclosure 60, in which case the remaining advantages of an easy to install and configure, single enclosure surround would still be widely appreciated as improvements over the prior art.

It will also be appreciated that the method and system of the present invention generally provides a self-contained, single enclosure surround sound system 50 for synthesizing left and right surround effects, and including an audio surround sound source having a filter network for generating filtered left and right channel surround signals; a single transducer enclosure 60 remote from said sound source transmitter; left and right laterally spaced controlled dispersion transducer arrays 68, 70 within the enclosure; an amplifier in said enclosure to receive said left and right channel surround signals and to direct said signals to respective left and right controlled dispersion transducer arrays to aim and project said surround signals to produce a synthesized surround sound audio experience for a listener (at 24); and wherein said filter network includes an attenuator and a delay for selected portions of each of said left and right channel signals. The system filter network includes high and low pass filters and an inverter for selected portions of the left and right channels, and the left channel signal and right channel signal are divided into selected specific filtered playback signals which are aimed (with controlled dispersion) at room reflective boundaries in a manner which relies on psychoacoustic principles and cranial anatomy to create a synthesized surround sound audio experience and which controls dispersion of the playback to generate an acoustic null in the direction of listener's position 24, so that the listener experiences de-localization of enclosure 60 (or the actual source position) while experiencing localization for the left and right phantom source positions proximate the reflective room boundaries.

Figure 22:
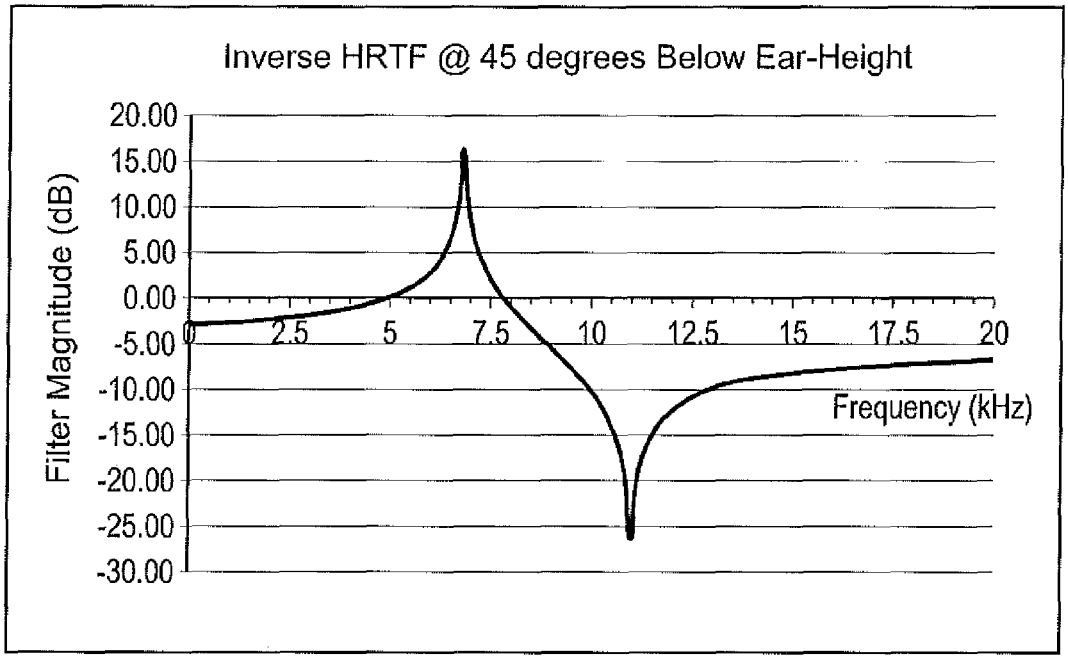
FIG. 22 illustrates the desired filter response corresponding to an inverse Head Related Transfer Function ("HRTF") for sound at 45 degrees below ear height, in accordance with an illustrative embodiment of the present invention.
Figure 23:
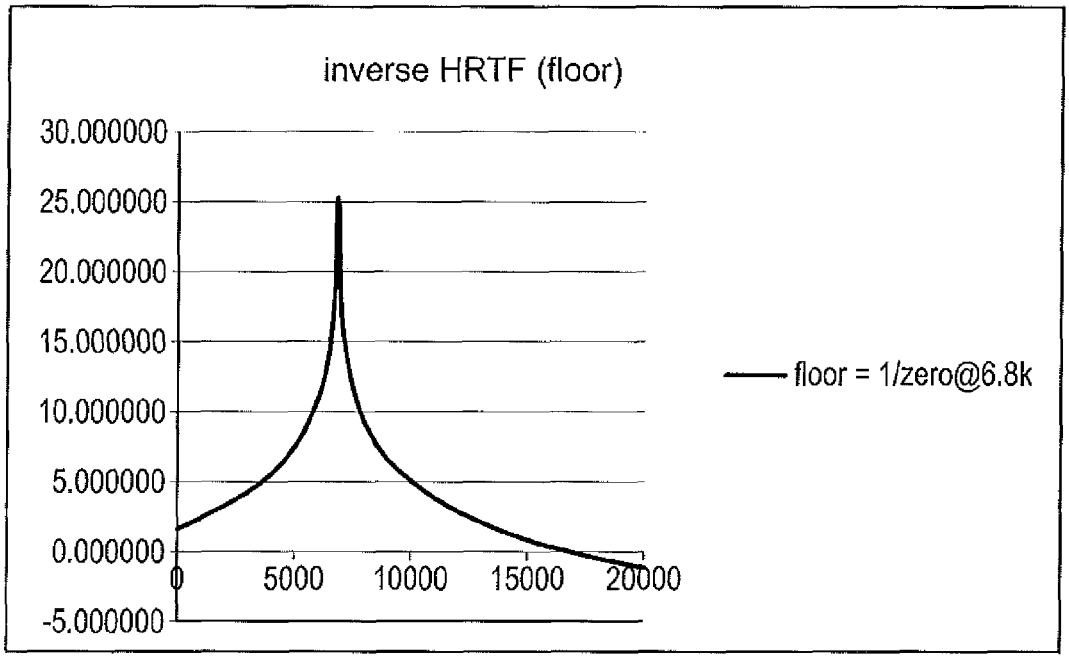
FIG. 23 illustrates an exemplary filter response corresponding to an inverse HRTF for sound from the floor, in accordance with an illustrative embodiment of the present invention.

Returning now to methods for magnitude response shaping, as discussed above and illustrated in FIG. 16, the preferred magnitude response for the "full-range" loudspeaker arrays 68, 70 (e.g., as illustrated in FIG. 16) are derived in part from the targeted HRTF ratio which relates the HRTF associated with the phantom, elevated source location to that associated with the actual loudspeaker location relative to the listener. From FIG. 14, it will be appreciated that within the primary audio bandwidth of loudspeaker system 50, acoustic sources located substantially below a seated listener's ear-height ($\phi \leq 30°$) are characterized by a prominent notch in the perceived acoustic magnitude (aka frequency) response centered at approximately 6.8 kHz. Also evident in the HRTF's associated with low source locations is a peak at approximately 12 kHz. By contrast, sources located substantially above ear-height ($\phi \geq 30°$) are relatively smooth in terms of perceived acoustic magnitude response. Therefore, if $HRTF_0$ represents the HRTF associated with floor placement and $HRTF_e$ is that associated with the desired, elevated source location then the application of their ratio, $HRTF_e/HRTF_0$ gives rise to a listener-perceived sense or impression of elevated acoustic sources (creation of elevated phantom images). This ratio may be simplified greatly if one approximates $HRTF_e$ as a "flat" (unity magnitude) source. Then, the inverse of $HRTF_0$ ($1/HRTF_0$ or $HRTF_0^{-1}$ which are mathematically identical) represents the appropriate transfer function for placing the perceived origin of acoustic sources well above seated listeners. This transfer function may be approximated by mathematical modeling the inverse of serial cut and boost filters set to 6.8 kHz and 11 kHz respectively, as shown below graphically. FIGS. 22 and 23 illustrate a graphical representation of $HRTF_0^{-1}$ for floor placement. Most notable in the response shown in FIG. 22 are the prominent peak centered at 6.8 kHz and the notch that occurs at 11 kHz.

Figure 24:
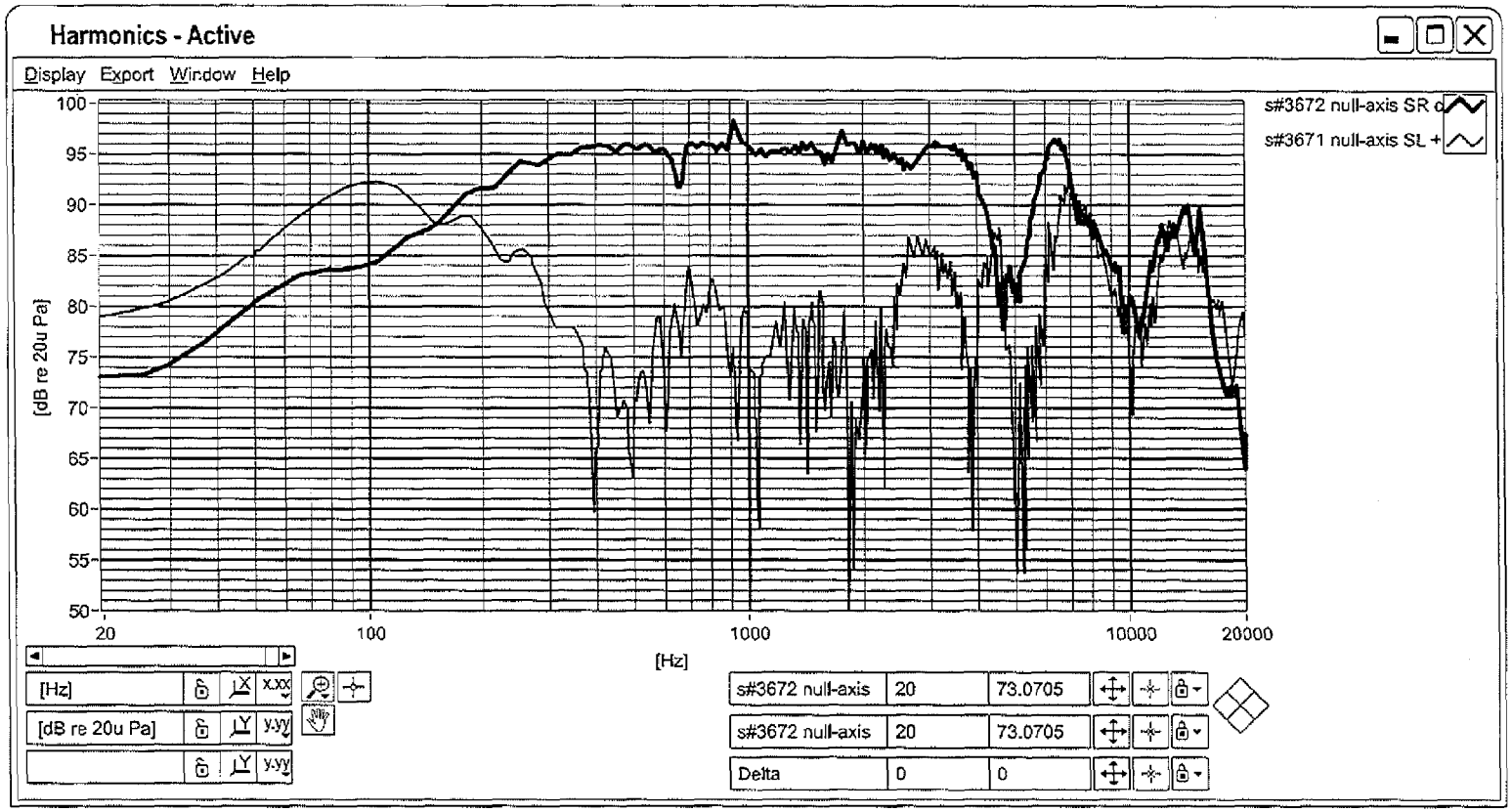
FIG. 24 illustrates an exemplary system's magnitude response for typical in-room setups, in accordance with an illustrative embodiment of the present invention.

The magnitude response graph of FIG. 24 illustrates the acoustic null directed towards listening locations for typical setups in accordance with the system and method of the present invention. Allowing for coherently summing output, if the surround channels were in-phase, the null depth is approximately 6 dB deeper than indicated (i.e., not 15 dB but 21 dB). While the upper trace indicates SR output in the null axis when the SL channel has been disabled, the lower darker trace reflects the summed output of both channels together in their normal out-of-phase condition. Over much of their primary bandwidth, bounded by 300 Hz and 4.5 kHz, the null is at least 20 dB. Therefore, reflected energy from the listening space's boundaries will dominate over attenuated direct energy from the enclosure and thereby enhance the listener's perceived acoustic envelopment and spaciousness.

The controlled dispersion or directivity of loudspeaker arrays 68, 70 depends on several factors including overall and pistonic bandwidth, array spacing, the number of drivers or loudspeaker elements in the array and the physical extent of each element in an array. The arrays 70 and 74 illustrated in FIGS. 5-7 and 9 are preferably each a pair of spaced 2.5" drivers whose acoustic bandwidth extends from approximately 250 Hz to nearly 20 kHz. In principle, larger arrays may be employed in order to achieve greater directivity. Persons of skill in the art will refer to applicant's chapter contribution to the publication entitled *Encyclopedia of Acoustics*, Wiley Inter-science, Vol. 4, ISBN 0-471-18007-6, (chapter 160, *Loudspeaker Design*, pp 1903-1924, see, e.g. at page 1906, FIG. 2 (entitled "Beamwidth v. ka" (where $ka=(2\pi \times f_a)/c$)) and Table 1), which illustrates, generally, how beamwidth varies in accordance with array size relative to acoustic wavelength. From Table 1 in said publication, it may be appreciated that an 8 inch (20 cm) electrodynamic driver's radiation pattern will have principal lobe(s) which subtend an angle of 60 degrees at 3.8 kHz assuming that its piston band extends sufficiently high in frequency. In the system and method of the present invention, each array 68, 70 is configured with driver axes approximately 15 mm normal to the axis of radiation. The beamwidth associated with an array or single transducer of this size is somewhat less than 30 degrees at frequencies above 3.5 kHz where $k*a=10$. It may be appreciated that k is wavenumber and equal to radian frequency divided by sound speed. That is, $k=2\pi f/c$, where f is frequency in Hertz and c is the speed of sound in air (approximately 1100 feet per second or 340 m/s).

Persons having skill in the art will appreciate that alternative embodiments are easily configured (once this description is understood) all in keeping within the true scope of the present invention. For example, an embodiment that omits the wireless aspect of the invention comprises an embodiment whereby all of the DSP and amplification is housed in a single enclosure along with the transducers. Also, an alternative version of the wireless embodiment is easily configured so that all of the signal processing is incorporated within in an alternative embodiment TX module 62A (not shown) or within in an alternative embodiment RX module 64A (not shown) rather than splitting it up between TX and RX.

Persons having skill in the art will appreciate that alternative embodiments are easily configured (once this description is understood) all in keeping within the true scope of the present invention. For example, an embodiment that omits the wireless aspect of the invention comprises an embodiment whereby all of the DSP and amplification is housed in a single enclosure along with the transducers. Also, an alternative version of the wireless embodiment is easily configured so that all of the signal processing is incorporated within in an alternative embodiment TX module 62A (not shown) or within in an alternative embodiment RX module 64A (not shown) rather than splitting it up between TX and RX.

Another variation (embodiment) omits the separate woofer driver. In principle, the two controlled directivity arrays 68, 70 may be configured to reproduce sufficient bass. It will be appreciated that the essence of the invention is a single enclosure system that reproduces multiple channels of audio (not necessarily surround or SB channels) with a credible soundstage of sufficient breadth and spaciousness created, in part, by use of HRTF inverse filtering, controlled directivity or directional multi-element transducer arrays and related means.

Also, as noted above, For purposes of this disclosure, the digital filter network of the invention will be illustrated as being incorporated within or located at the transmitter 62, although it will be understood that digital filtering can be incorporated elsewhere (e.g., portions being incorporated in the receiver ("RX" similar to 64), where the system mixes the 4 baseband channels down to 2 and performs some of the processing (e.g., delay, attenuate SB channels+employ an APF on the SBR channel) in the transmitter ("TX" similar to 62), with most of the DSP occurring in the RX 64).

Having described preferred embodiments of a new and improved system and method, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A surround sound system for audio installations in a room, having at least one listening position, comprising:

an audio surround sound wireless signal source having a filter network with adjustable filter parameters which are adjusted according to measured audio spatial cues to generate filtered left and right channel surround signals and a wireless transmitter for transmitting filtered left and right channel surround signals;

a single compact enclosure configured for placement by a user on a floor, table or shelf in the room and behind the listening position, said single compact enclosure being positioned at a location remote from said surround sound wireless signal source;

said single compact enclosure including left and right laterally spaced loudspeaker arrays mounted within said enclosure; and a receiver located in said single compact enclosure to receive said filtered left and right channel surround signals and to direct said signals to respective left and right loudspeaker arrays to radiate said filtered left and right channel surround signals to produce a surround sound audio experience for a listener when in said listening position.

2. The system of claim 1, wherein said wireless signal source filter network includes an attenuator and a delay for selected portions of each of said left and right channel signals.

3. The system of claim 2, wherein said filter network includes high and low pass filters and an inverter for selected portions of said left and right channels.

4. The system of claim 1, wherein:

said audio surround sound wireless signal source includes a left channel having SL and SBL audio surround signals and a right channel having SR and SBR audio surround signals; and said filter network includes a left channel attenuator and delay circuit for said SBL signals and a right channel attenuator and delay circuit for said SBR signals, an all pass filter including a phase inverter for one of said SBL and SBR signals, a first mixer for summing said SL and attenuated and delayed SBL signals to provide a filtered and mixed left channel signal, and a second mixer for summing said SR and attenuated and delayed SBR signals to provide a filtered and mixed right channel signal; whereby filtered and mixed left and right channel signals are transmitted to said receiver.

5. The system of claim 4, wherein said single compact enclosure receiver includes:

a demodulator for separating said filtered and mixed left and right channel signals;

low-pass filters for directing selected signals from said left and right channels to a subwoofer transducer in said single compact enclosure;

high pass filters for directing said mixed left channel signals and said mixed right channel signal to a digital sound processor for producing shaped left and right channel audio signals; and left and right channel amplifiers connecting said shaped left and right channel audio signals to corresponding left and right loudspeaker arrays.

6. The system of claim 5, wherein said digital sound processor includes selectable sets of bi-quad filters producing corresponding sets of audio shaping characteristics for said left and right channel audio signals, whereby said loudspeaker arrays radiate shaped audio surround sound patterns that emulate multiple phantom speaker enclosures.

7. A method for driving a single-enclosure loudspeaker system which incorporates multiple loudspeaker arrays, comprising:

providing a loudspeaker system comprising single compact enclosure with left and right loudspeaker arrays, wherein said single compact enclosure is configured for placement behind a listening position in a room;

supplying left and right surround audio signals from an audio source to filter circuitry which adjusts filter parameters of said filter circuitry according to measured audio special cues after said supplying based on psychoacoustic principles and analyses of cranial anatomy of listeners to provide filtered left and right channel audio surround signals; and transmitting the filtered audio surround signals wirelessly to the single compact enclosure loudspeaker system to drive corresponding left and right loudspeaker arrays in the single enclosure to project multi-channel surround sound into said room to produce sounds which, from said listening position, are perceived as radiating from phantom surround sound speaker positions.

8. The method of claim 7, further including:

locating said left and right loudspeaker arrays on laterally opposed sides of said single enclosure;

dividing filtered audio surround signals received at said single enclosure into left and right audio signals; and supplying the left and right audio signals to said loudspeaker arrays to project surround sound from each transducer array toward respective reflecting surfaces in said room.

9. The method of claim 8, further including:

digitally processing said left and right audio signals to produce selectable sets of shaped characteristics for said left and right channel audio signals; and selecting a set of characteristics whereby said loudspeaker arrays radiate a specified shaped audio surround sound pattern that emulates phantom speaker enclosures.

10. The method of claim 9, wherein digitally processing said left and right audio signals provides psycho-acoustic cues appropriate for both de-localization of the actual source position and for localization to the preferred phantom source positions of the radiated shaped surround sound patterns.

11. A surround sound system for audio installations in a room having a front wall with a display and a rear wall and a listening position or station located between the front wall and rear wall, comprising:

an audio surround sound wireless signal source having a wireless transmitter for transmitting left and right channel surround signals;

a single compact enclosure loudspeaker system configured for placement by a user on a floor, table or shelf at a first selected location in the room, between the listening position and the rear wall, wherein said single compact enclosure's first selected location is remote from said surround sound wireless signal source;

said single compact enclosure including a first, left loudspeaker array mounted within said enclosure and oriented to radiate outwardly and upwardly in first, left controlled dispersion radiation pattern aimed at a first room boundary when said single compact enclosure is placed at said first selected location; said single compact enclosure also including a second opposing right laterally spaced loudspeaker array mounted within said enclosure and oriented to radiate outwardly and upwardly in a second, right controlled dispersion radiation pattern aimed at a second room boundary when said single compact enclosure is placed at said first selected location; and wherein said surround sound system also includes a filter network with adjustable filter parameters which are adjusted according to measured audio spatial cues to generate filtered left and right channel surround signals, and wherein said single compact enclosure loudspeaker system including a receiver tuned to receive said left and right channel surround signals and to direct said signals to said respective left and right loudspeaker arrays to radiate said left and right channel surround signals to produce said first and second controlled dispersion radiation patterns to provide a surround sound audio experience for a listener when in said listening position.

12. The system of claim 11, wherein said wireless signal source includes said filter network with adjustable filter parameters comprising an attenuator and a delay for selected portions of each of said left and right channel signals.

13. The system of claim 12, wherein said filter network with adjustable filter parameters includes high and low pass filters and an inverter for selected portions of said left and right channels.

14. The system of claim 11, wherein:

said audio surround sound wireless signal source includes a left channel having SL and SBL audio surround signals and a right channel having SR and SBR audio surround signals; and said system further comprises a filter network including a left channel attenuator and delay circuit for said SBL signals and a right channel attenuator and delay circuit for said SBR signals, an all-pass filter including a phase inverter for one of said SBL and SBR signals, a first mixer for summing said SL and attenuated and delayed SBL signals to provide a filtered and mixed left channel signal, and a second mixer for summing said SR and attenuated and delayed SBR signals to provide a filtered and mixed right channel signal, whereby filtered and mixed left and right channel signals are generated for said first, left speaker may and said second, right speaker array.

15. The system of claim 14, wherein said single compact enclosure receiver includes:

a demodulator for separating said filtered and mixed left and right channel signals;

low-pass filters for directing selected signals from said left and right channels to a subwoofer transducer in said single compact enclosure;

high pass filters for directing said mixed left channel signals and said mixed right channel signal to a digital sound processor for producing shaped left and right channel audio signals; and left and right channel amplifiers connecting said shaped left and right channel audio signals to corresponding left and right speaker arrays.

16. The system of claim 15, wherein said digital sound processor includes selectable sets of bi-quad filters producing corresponding sets of audio shaping characteristics for said left and right channel audio signals, whereby said transducer arrays radiate shaped audio surround sound patterns that emulate multiple phantom speaker enclosures.

17. The system of claim 11, wherein said single compact enclosure includes left and right laterally spaced end walls which are sloped inwardly and upwardly to form a selected controlled dispersion radiation aiming angle I' with respect to a horizontal base.

18. The system of claim 17, wherein said controlled dispersion radiation aiming angle $\Psi$ is 45°, so that the supported speaker arrays project at a 45° angle toward said first and second room boundaries.

19. The system of claim 17, wherein said left and right transducer arrays radiate said left and right channel surround signals to produce said first and second controlled dispersion radiation patterns which combine in said room to generate a dipolar radiation pattern with null regions aligned along a fore/aft axis of the listening space which substantially intersects the listening position, thus diminishing auditory cues which a listener would perceive as originating directly from said single compact enclosure loudspeaker system's first selected location.

20. The system of claim 16, wherein said left and right channel SBL and SBR signals are pre-filtered for polarity inversion above the phase turnover (crossover) frequency of said all-pass filter, so that phase inversion within the receiver signal path ensures phase coherence of the Surround Back channels;

wherein a radiation pattern generated in response to said SBL and SBR signals is approximately monopolar and substantially Omni-directional, thus providing relatively more direct sound into the listening position, and wherein said SBL and SBR signals are delayed relative to the SL and SR signals so that auditory cues originating directly from said single compact enclosure loudspeaker system, in addition to the reflected sounds, support proper localization of any discrete rear surround effects.

* * * * *

UNITED STATES PATENT AND TRADEMARK OFFICE

CERTIFICATE OF CORRECTION

PATENT NO. : 9,185,490 B2
APPLICATION NO. : 13/295972
DATED : November 10, 2015
INVENTOR(S) : Starobin It is certified that error appears in the above-identified patent and that said Letters Patent is hereby corrected as shown below:

In the Claims:

In claim 14, column 19 line 48 reads:

"said first, left speaker may and said second, right speaker"

It should read:

"said first, left speaker array and said second, right speaker"

In claim 17, column 20 line 21 reads:

"controlled dispersion radiation aiming angle $I^{\dagger}$ with respect to"

It should read:

"controlled dispersion radiation aiming angle $\Psi$ with respect to"

Signed and Sealed this
Seventeenth Day of May, 2016

Michelle K. Lee

Michelle K. Lee
*Director of the United States Patent and Trademark Office*